US010191423B2

(12) United States Patent
Sugiyama et al.

(10) Patent No.: US 10,191,423 B2
(45) Date of Patent: Jan. 29, 2019

(54) IMAGE FORMING APPARATUS INCLUDING A FIXING DEVICE

(71) Applicants: Ryohhei Sugiyama, Kanagawa (JP); Hironori Yamaoka, Kanagawa (JP); Takashi Sakamaki, Kanagawa (JP); Tetsuo Tokuda, Tokyo (JP); Akiyasu Amita, Kanagawa (JP); Shinichi Namekata, Kanagawa (JP); Yohhei Watanabe, Kanagawa (JP); Fumihiro Hirose, Kanagawa (JP); Teppei Kawata, Kanagawa (JP); Masateru Ujiie, Kanagawa (JP)

(72) Inventors: Ryohhei Sugiyama, Kanagawa (JP); Hironori Yamaoka, Kanagawa (JP); Takashi Sakamaki, Kanagawa (JP); Tetsuo Tokuda, Tokyo (JP); Akiyasu Amita, Kanagawa (JP); Shinichi Namekata, Kanagawa (JP); Yohhei Watanabe, Kanagawa (JP); Fumihiro Hirose, Kanagawa (JP); Teppei Kawata, Kanagawa (JP); Masateru Ujiie, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/708,734

(22) Filed: Sep. 19, 2017

(65) Prior Publication Data

US 2018/0088502 A1 Mar. 29, 2018

(30) Foreign Application Priority Data

Sep. 28, 2016 (JP) ..... 2016-189330
Apr. 4, 2017 (JP) ..... 2017-074508

(51) Int. Cl.
*G03G 15/20* (2006.01)

(52) U.S. Cl.
CPC ..... *G03G 15/2089* (2013.01); *G03G 15/206* (2013.01); *G03G 15/2032* (2013.01); *G03G 15/2064* (2013.01); *G03G 2215/2032* (2013.01)

(58) Field of Classification Search
CPC ..... G03G 15/2032; G03G 15/2053; G03G 15/2064; G03G 15/2067; G03G 15/2078; G03G 15/2089; G03G 15/206
See application file for complete search history.

(56) References Cited

U.S. PATENT DOCUMENTS

2011/0170917 A1 7/2011 Yoshikawa et al.
2011/0222887 A1 9/2011 Tao et al.
(Continued)

FOREIGN PATENT DOCUMENTS

JP 2007-024931 2/2007
JP 2010-204222 9/2010
(Continued)

*Primary Examiner* — Hoang Ngo
(74) *Attorney, Agent, or Firm* — Oblon, McClelland, Maier & Neustadt, L.L.P.

(57) ABSTRACT

An image forming apparatus includes a fixing belt stretched across a first roller and a second roller including an elastic layer. A pressure rotator presses against the second roller via the fixing belt to form a fixing nip between the pressure rotator and the fixing belt. A recording medium bearing a toner image is conveyed through the fixing nip. A clearance detector detects a clearance between the first roller and the second roller. A mover moves the pressure rotator with respect to the second roller in a pressing direction in which the pressure rotator presses against the second roller via the fixing belt and a separation direction in which the pressure rotator separates from the second roller. A controller controls an amount of movement of the pressure rotator moved by the mover toward the second roller based on the clearance detected by the clearance detector.

18 Claims, 10 Drawing Sheets

(56) References Cited

U.S. PATENT DOCUMENTS

| | | | |
|---|---|---|---|
| 2011/0311246 | A1 | 12/2011 | Masuda et al. |
| 2011/0311249 | A1 | 12/2011 | Kubota et al. |
| 2012/0177393 | A1 | 7/2012 | Ikebuchi et al. |
| 2014/0294456 | A1 | 10/2014 | Ueno et al. |
| 2016/0004199 | A1 | 1/2016 | Suzuki et al. |
| 2016/0124357 | A1 | 5/2016 | Ujiie et al. |
| 2016/0202646 | A1 | 7/2016 | Suzuki et al. |
| 2016/0306311 | A1 | 10/2016 | Ono et al. |
| 2017/0131666 | A1 | 5/2017 | Sugiyama et al. |
| 2017/0146933 | A1 | 5/2017 | Yamano et al. |

FOREIGN PATENT DOCUMENTS

| | | |
|---|---|---|
| JP | 2011-186395 | 9/2011 |
| JP | 2012-003171 | 1/2012 |
| JP | 2012-022298 | 2/2012 |
| JP | 2012-042755 | 3/2012 |
| JP | 2012-042756 | 3/2012 |
| JP | 2016-206644 | 12/2016 |
| JP | 2016-218399 | 12/2016 |
| JP | 2017-090879 | 5/2017 |
| JP | 2017-097183 | 6/2017 |
| JP | 2017-126001 | 7/2017 |

IMAGE FORMING APPARATUS INCLUDING A FIXING DEVICE

CROSS-REFERENCE TO RELATED APPLICATIONS

This patent application is based on and claims priority pursuant to 35 U.S.C. § 119 to Japanese Patent Application Nos. 2016-189330, filed on Sep. 28, 2016, and 2017-074508, filed on Apr. 4, 2017, in the Japanese Patent Office, the entire disclosure of each of which is hereby incorporated by reference herein.

BACKGROUND

Technical Field

Exemplary aspects of the present disclosure relate to an image forming apparatus, and more particularly, to an image forming apparatus for forming an image on a recording medium.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved image forming apparatus. In one exemplary embodiment, the image forming apparatus includes a first roller and a second roller including an elastic layer as an outer circumferential layer. A fixing belt is stretched taut across at least the first roller and the second roller. A pressure rotator presses against the second roller via the fixing belt to form a fixing nip between the pressure rotator and the fixing belt. A recording medium bearing a toner image is conveyed through the fixing nip. A clearance detector detects a clearance between the first roller and the second roller. A mover moves the pressure rotator with respect to the second roller in a pressing direction in which the pressure rotator presses against the second roller via the fixing belt and a separation direction in which the pressure rotator separates from the second roller. A controller controls an amount of movement of the pressure rotator moved by the mover toward the second roller based on the clearance detected by the clearance detector.

This specification further describes an improved image forming apparatus. In one exemplary embodiment, the image forming apparatus includes a fixing roller including a core bar and an elastic layer coating the core bar. A pressure rotator presses against the fixing roller to form a fixing nip between the pressure rotator and the fixing roller. A recording medium bearing a toner image is conveyed through the fixing nip. A core bar temperature detector detects a temperature of the core bar of the fixing roller. A mover moves the pressure rotator with respect to the fixing roller in a pressing direction in which the pressure rotator presses against the fixing roller and a separation direction in which the pressure rotator separates from the fixing roller. A controller controls the mover to move the pressure rotator gradually from a default position in the separation direction whenever the temperature of the core bar detected by the core bar temperature detector exceeds each of a plurality of thresholds for the temperature of the core bar.

This specification further describes an improved image forming apparatus. In one exemplary embodiment, the image forming apparatus includes a fixing device including a fixing roller including a core bar and an elastic layer coating the core bar. A pressure rotator presses against the fixing roller to form a fixing nip between the pressure rotator and the fixing roller. A recording medium bearing a toner image is conveyed through the fixing nip. A core bar temperature detector detects a temperature of the core bar of the fixing roller. A mover moves the pressure rotator with respect to the fixing roller in a pressing direction in which the pressure rotator presses against the fixing roller and a separation direction in which the pressure rotator separates from the fixing roller. A controller controls the mover to move the pressure rotator according to the temperature of the core bar detected by the core bar temperature detector while the recording medium is conveyed through the fixing nip. The controller determines a heat storage state of the fixing roller after the image forming apparatus receives a current print job and before the recording medium is conveyed through the fixing nip. The controller performs a heat storage and movement control to heat the fixing roller and move the pressure rotator based on the determined heat storage state.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
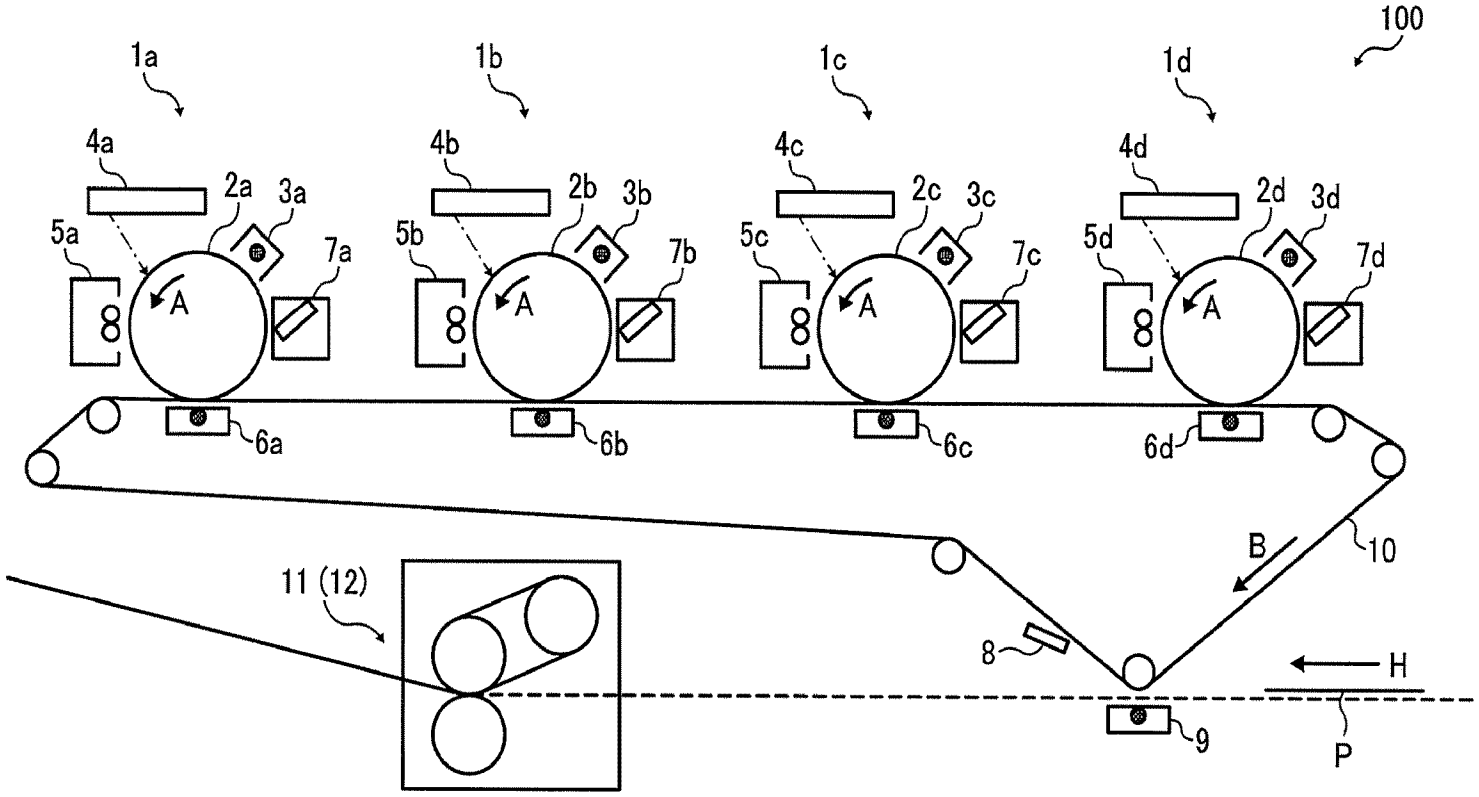
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 according to an embodiment is explained.

The image forming apparatus 100 may be a copier, a facsimile machine, a printer, a multifunction peripheral or a multifunction printer (MFP) having at least one of copying, printing, scanning, facsimile, and plotter functions, or the like. According to this embodiment, the image forming apparatus 100 is a color printer that forms a color toner image on a recording medium by electrophotography. Alternatively, the image forming apparatus 100 may be a monochrome printer that forms a monochrome toner image on a recording medium.

Referring to FIGS. 1 to 14, a detailed description is provided of configurations according to embodiments of the present disclosure.

In the embodiments described below, the description is provided by referring to a color laser printer employing a tandem system as one example of the image forming apparatus 100 and fixing devices employing a belt fixing system as one example of a fixing device incorporated in the image forming apparatus 100.

A description is provided of a construction of the image forming apparatus 100.

FIG. 1 is a schematic vertical cross-sectional view of the image forming apparatus 100, that is, the color laser printer. The image forming apparatus 100 includes image forming units 1*a*, 1*b*, 1*c*, and 1*d* serving as image forming devices that form toner images in four colors, that is, yellow, magenta, cyan, and black toner images, respectively. The image forming apparatus 100 is the color laser printer employing the tandem system in which the image forming units 1*a*, 1*b*, 1*c*, and 1*d* are aligned in a rotation direction B of a transfer belt 10.

The image forming units 1*a*, 1*b*, 1*c*, and 1*d* include photoconductors 2*a*, 2*b*, 2*c*, and 2*d*, drum chargers 3*a*, 3*b*, 3*c*, and 3*d*, exposure devices 4*a*, 4*b*, 4*c*, and 4*d*, developing devices 5*a*, 5*b*, 5*c*, and 5*d*, primary transfer devices 6*a*, 6*b*, 6*c*, and 6*d*, and cleaners 7*a*, 7*b*, 7*c*, and 7*d*, respectively. Each of the photoconductors 2*a*, 2*b*, 2*c*, and 2*d* is a drum that rotates in a rotation direction A. The drum chargers 3*a*, 3*b*, 3*c*, and 3*d* uniformly change an outer circumferential surface of the photoconductors 2*a*, 2*b*, 2*c*, and 2*d* that rotate in the rotation direction A, respectively. The exposure devices 4*a*, 4*b*, 4*c*, and 4*d* irradiate the outer circumferential surface of the photoconductors 2*a*, 2*b*, 2*c*, and 2*d* charged by the drum chargers 3*a*, 3*b*, 3*c*, and 3*d* with laser beams according to image data, thus forming electrostatic latent images on the photoconductors 2*a*, 2*b*, 2*c*, and 2*d*, respectively. The developing devices 5*a*, 5*b*, 5*c*, and 5*d* develop the electrostatic latent images formed on the photoconductors 2*a*, 2*b*, 2*c*, and 2*d* by the exposure devices 4*a*, 4*b*, 4*c*, and 4*d* with yellow, magenta, cyan, and black toners into yellow, magenta, cyan, and black toner images, respectively. The primary transfer devices 6*a*, 6*b*, 6*c*, and 6*d* primarily transfer the yellow, magenta, cyan, and black toner images formed on the photoconductors 2*a*, 2*b*, 2*c*, and 2*d* by the developing devices 5*a*, 5*b*, 5*c*, and 5*d*, respectively, onto the transfer belt 10. The cleaners 7*a*, 7*b*, 7*c*, and 7*d* clean the outer circumferential surface of the photoconductors 2*a*, 2*b*, 2*c*, and 2*d*, respectively.

As the yellow, magenta, cyan, and black toner images formed by the image forming units 1*a*, 1*b*, 1*c*, and 1*d* are primarily transferred onto the transfer belt 10 such that the yellow, magenta, cyan, and black toner images are superimposed on a same position on the transfer belt 10, a full color toner image is formed on the transfer belt 10. When the full color toner image formed on the transfer belt 10 reaches a secondary transfer device 9, the secondary transfer device 9 applied with a high voltage secondarily transfers the full color toner image onto a recording medium P being conveyed in a recording medium conveyance direction H and passing through a secondary transfer nip formed between the transfer belt 10 and the secondary transfer device 9. A belt cleaner 8 collects residual toner failed to be transferred onto the recording medium P and therefore remaining on the transfer belt 10 from the transfer belt 10. A fixing device 11 or 12 fixes the full color toner image transferred onto the recording medium P thereon.

A description is provided of a configuration of the fixing device 11 according to a first embodiment.

Figure 2:
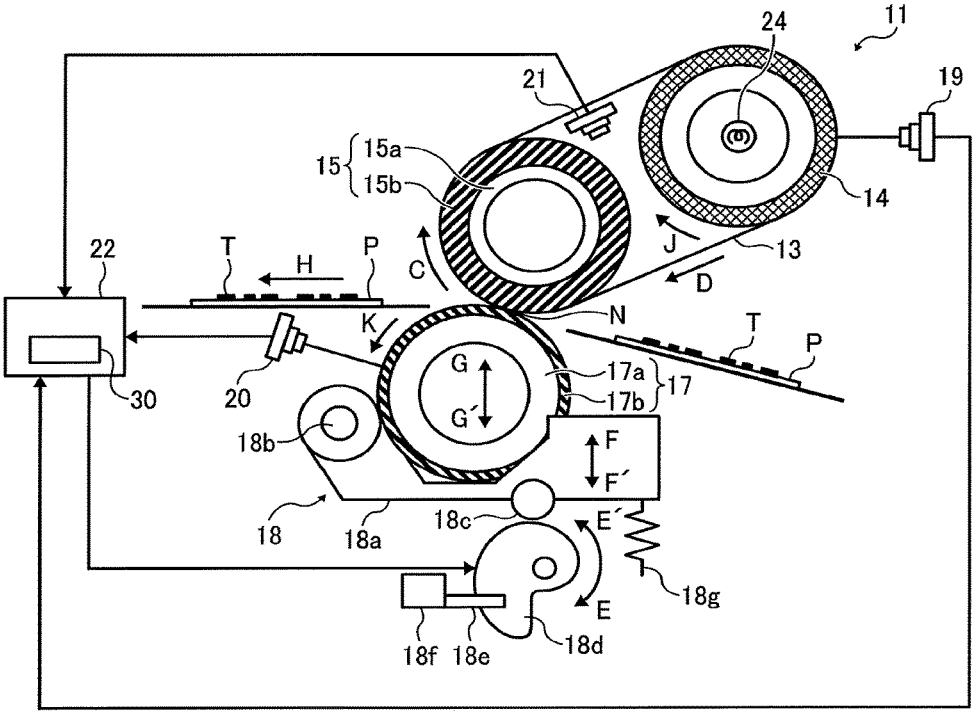
FIG. 2 is a schematic vertical cross-sectional view of a fixing device according to a first embodiment, which is incorporated in the image forming apparatus depicted in FIG. 1.

As illustrated in FIG. 2, the fixing device 11 includes a fixing roller 15, a heater 24, a heating roller 14, a fixing belt 13, a pressure roller 17, a clearance sensor 21, a pressure roller mover 18, and a controller 22. The fixing roller 15 includes an elastic layer 15*b* as an outer circumferential layer that has an outer circumferential surface of the fixing roller 15. The heater 24 heats the heating roller 14. The fixing belt 13 is stretched taut across at least the fixing roller 15 and the heating roller 14. The pressure roller 17 serving as a pressure rotator is pressed against the fixing roller 15 via the fixing belt 13 to form a fixing nip N between the pressure roller 17 and the fixing belt 13. The clearance sensor 21 serving as a clearance detector detects a clearance, that is, a distance, between the fixing roller 15 and the heating roller 14. The pressure roller mover 18 serving as a mover moves the pressure roller 17 with respect to the fixing roller 15 in a pressing direction in which the pressure roller 17 presses against the fixing roller 15 via the fixing belt 13 and a separation direction in which the pressure roller 17 separates from the fixing roller 15. The controller 22 controls an amount of movement of the pressure roller 17 moved by the pressure roller mover 18 toward the fixing roller 15 based on the clearance between the fixing roller 15 and the heating roller 14, which is detected by the clearance sensor 21. The fixing device 12 according to a second embodiment is marked with parentheses in FIG. 1.

A description is provided of a construction of the fixing device 11.

FIG. 2 is a schematic vertical cross-sectional view of the fixing device 11. The fixing device 11 (e.g., a fuser or a fusing unit) employs the belt fixing system incorporating the fixing belt 13 serving as a fixing rotator. In addition to the fixing belt 13, the fixing device 11 includes the heating roller 14, the fixing roller 15, the pressure roller 17, the pressure roller mover 18, a fixing belt temperature sensor 19, a pressure roller temperature sensor 20, the clearance sensor 21, and the controller 22.

A detailed description is now given of a construction of the fixing belt 13.

The fixing belt 13 serving as a fixing rotator rotatable in a rotation direction D is a multi-layer endless belt constructed of a base layer, an elastic layer coating the base layer, and a release layer coating the elastic layer. The base layer is made of resin. The elastic layer is made of an elastic material such as fluoro rubber, silicone rubber, and silicone rubber foam. The release layer is made of tetrafluoroethylene-perfluoroalkylvinylether copolymer (PFA), polyimide D, polyether imide (PEI), polyether sulfide (PES), or the like. The release layer serving as a surface layer of the fixing belt 13 facilitates separation or peeling-off of toner of a toner image T on a recording medium P from the fixing belt 13. The fixing belt 13 is stretched taut across and supported by two rollers, that is, the heating roller 14 and the fixing roller 15. The fixing device 11 may include a tension roller that places a predetermined tension to the fixing belt 13.

A detailed description is now given of a configuration of the heating roller 14.

The heating roller 14 is a thin tube made of metal and rotatable in a rotation direction J. The heater 24 serving as a heater or a heat source is stationarily disposed inside the tube of the heating roller 14.

The heater 24 is a halogen heater or a carbon heater, for example. Both lateral ends of the heater 24 in a longitudinal direction thereof are mounted on or secured to side plates of the fixing device 11, respectively. Shafts of the heating roller 14 disposed at both lateral ends of the heating roller 14 in an axial direction thereof are rotatably mounted on the side plates of the fixing device 11 through bearings, respectively.

A detailed description is now given of a configuration of the heater 24.

As the heater 24 is supplied with power from a power supply (e.g., an alternating current power supply) of the image forming apparatus 100, of which output is controlled, the heater 24 generates heat. The heater 24 heats the heating roller 14 with radiant heat. The heating roller 14 conducts heat to the fixing belt 13. The heat is further conducted from an outer circumferential surface of the fixing belt 13 to a toner image T on a recording medium P.

The fixing belt temperature sensor 19 (e.g., a thermopile) disposed opposite the outer circumferential surface of the fixing belt 13 detects the temperature of the outer circumferential surface of the fixing belt 13. The controller 22 controls output of the heater 24 such that the temperature of the outer circumferential surface of the fixing belt 13 is adjusted to a desired control temperature (e.g., a fixing temperature) constantly. The heating roller 14 is made of metal and has a linear expansion coefficient that is substantially smaller than that of the fixing roller 15.

A detailed description is now given of a construction of the fixing roller 15.

The fixing roller 15 is a roller constructed of a core bar 15*a* made of stainless steel (e.g., SUS304 and SUS420) or the like and an elastic layer 15*b* coating the core bar 15*a* and being made of fluoro rubber, silicone rubber, silicone rubber foam, or the like.

A detailed description is now given of a construction of the pressure roller 17.

The pressure roller 17 is a roller constructed of a core bar 17*a* made of stainless steel (e.g., SUS304 and SUS420) or the like and an elastic layer 17*b* coating the core bar 17*a* and being made of fluoro rubber, silicone rubber, silicone rubber foam, or the like.

Shafts of the pressure roller 17 disposed at both lateral ends of the pressure roller 17 in an axial direction thereof are rotatably mounted on the side plates of the fixing device 11 through bearings, respectively. A driver (e.g., a motor) drives and rotates the pressure roller 17. Shafts of the fixing roller 15 disposed at both lateral ends of the fixing roller 15 in an axial direction thereof are rotatably mounted on the side plates of the fixing device 11 through bearings, respectively. As the driver drives and rotates the pressure roller 17 in a rotation direction K, the pressure roller 17 drives and rotates the fixing roller 15 via the fixing belt 13 clockwise in a rotation direction C. The pressure roller 17 also drives and rotates the fixing belt 13 in the rotation direction D. Alternatively, the driver (e.g., the motor) may drive and rotate the fixing roller 15.

A detailed description is now given of a configuration of the pressure roller temperature sensor 20.

The pressure roller temperature sensor 20 is a temperature sensor (e.g., a thermopile) disposed opposite an outer circumferential surface of the pressure roller 17. The pressure roller temperature sensor 20 detects the temperature of the outer circumferential surface of the pressure roller 17.

The pressure roller 17 is pressed against the fixing roller 15 via the fixing belt 13 to form the fixing nip N between the pressure roller 17 and the fixing belt 13. In order to form the fixing nip N, a layer thickness of the elastic layer 15*b* of the fixing roller 15 is greater than a layer thickness of the elastic layer 17*b* of the pressure roller 17. For example, the elastic layer 17*b* of the pressure roller 17 has a layer thickness of 2 mm. The elastic layer 15*b* of the fixing roller 15 has a layer thickness of 15 mm.

A detailed description is now given of a construction of the pressure roller mover 18. The pressure roller mover 18 includes a pivot arm 18*a*. The pivot arm 18*a* rotatably supports the bearing disposed at each lateral end of the pressure roller 17 in the axial direction thereof. The pivot arm 18*a* is pivotable about a pivot shaft 18*b* disposed at one end of the pivot arm 18*a* in a longitudinal direction thereof. A bearing 18*c* is secured to another end of the pivot arm 18*a* in the longitudinal direction thereof. A cam 18*d* is disposed below and in contact with the bearing 18*c* in FIG. 2. The cam 18*d* is driven by a motor (e.g., a stepping motor) capable of controlling a rotation angle of the cam 18*d*. The cam 18*d* mounts a shield plate 18*e* that is detected by a cam position detector 18*f*. As the cam position detector 18*f* detects the position of the shield plate 18*e*, the controller 22 determines a reference position, that is, a default position, of the cam 18*d*.

A pivot arm spring 18*g* anchored to the pivot arm 18*a* places tension to the cam 18*d*, which retains the cam 18*d* in contact with the bearing 18*c*. As the motor drives and rotates the cam 18*d* in a rotation direction E, the bearing 18*c* moves in a direction F. Accordingly, the pressure roller 17 supported by the pivot arm 18*a* moves toward the fixing roller 15 in a direction G. Conversely, as the motor drives and rotates the cam 18*d* in a rotation direction E', the bearing 18*c* moves in a direction F'. Accordingly, the pressure roller 17 supported by the pivot arm 18*a* moves away or separates from the fixing roller 15 in a direction G'.

A detailed description is now given of a configuration of the clearance sensor 21.

The clearance sensor 21 is a two-dimensional optical displacement meter or the like, for example. The clearance sensor 21 is disposed opposite an inner circumferential surface of the fixing belt 13. The clearance sensor 21 detects the length of the clearance between the fixing roller 15 and the heating roller 14.

A detailed description is now given of a configuration of the controller 22.

The controller 22 controls output of the heater 24 based on the temperature of the fixing belt 13 detected by the fixing belt temperature sensor 19 so that the temperature of the outer circumferential surface of the fixing belt 13 is adjusted to the desired fixing temperature. Alternatively, the controller 22 may control output of the heater 24 based on the temperature of the pressure roller 17 detected by the pressure roller temperature sensor 20 in addition to the temperature of the fixing belt 13 detected by the fixing belt temperature sensor 19.

Further, the controller 22 controls the pressure roller mover 18 based on a detection result provided by the clearance sensor 21, thus controlling the position of the pressure roller 17. The controller 22 includes a memory 30 that stores information as needed. The controller 22 may be a controller for the fixing device 11 or a part of a controller that controls the image forming apparatus 100.

A description is provided of a control method of the fixing device 11.

In order to heat and melt the toner image T on the recording medium P to fix the toner image T on the recording medium P stably, the controller 22 is requested to adjust the length of the fixing nip N in the recording medium conveyance direction H where the fixing roller 15 and the pressure roller 17 sandwich the recording medium P according to the type of the recording medium P so as to heat the toner image T with an appropriate amount of heat.

The controller 22 controls the pressure roller mover 18 to move the pressure roller 17 in the pressing direction in which the pressure roller 17 presses against the fixing roller 15 via the fixing belt 13 and the separation direction in which the pressure roller 17 separates from the fixing roller 15, thus adjusting the position of the pressure roller 17 with respect to the fixing roller 15 and thereby adjusting the length of the fixing nip N in the recording medium conveyance direction H.

However, when the elastic layer 15*b* of the fixing roller 15 expands thermally as the temperature of the fixing roller 15 increases and therefore the outer diameter of the fixing roller 15 increases, even if the position of the pressure roller 17 with respect to the fixing roller 15 is set at a predetermined position, the length of the fixing nip N in the recording medium conveyance direction H may change, resulting in fluctuation in fixing performance.

To address this circumstance, with the fixing device 11 according to this embodiment, the controller 22 calculates an amount of change in the outer diameter of the fixing roller 15 based on the length of the clearance between the fixing roller 15 and the heating roller 14, which is detected by the clearance sensor 21. The controller 22 controls the amount of movement of the pressure roller 17 moved by the pressure roller mover 18 toward the fixing roller 15 based on the amount of change in the outer diameter of the fixing roller 15, thus attaining an appropriate length of the fixing nip N in the recording medium conveyance direction H.

Figure 3:
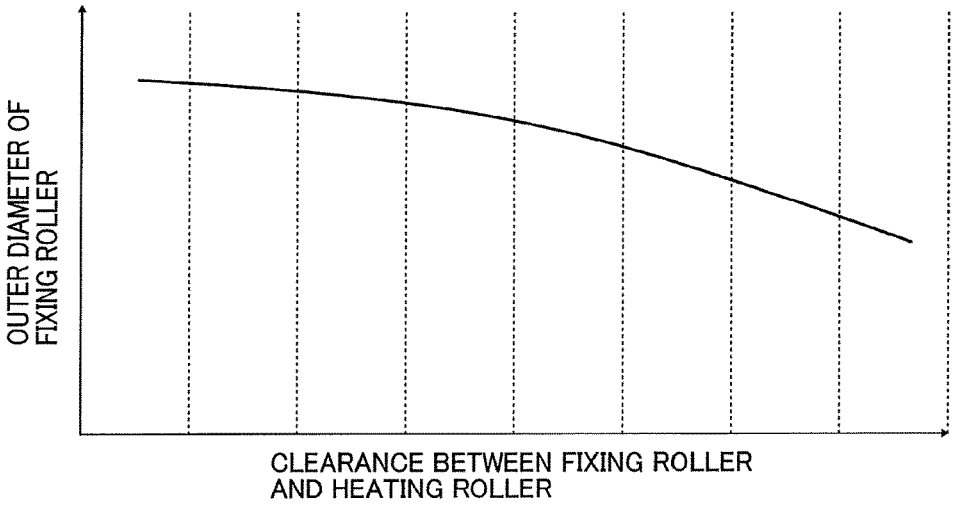
FIG. 3 is a graph illustrating a relation between a clearance between a fixing roller and a heating roller and an outer diameter of the fixing roller of the fixing device depicted in FIG. 2.

FIG. 3 is a graph illustrating a relation between the clearance between the fixing roller 15 and the heating roller 14 and the outer diameter of the fixing roller 15. As illustrated in FIG. 3, when the outer diameter of the fixing roller 15 is small, the clearance between the fixing roller 15 and the heating roller 14, which is detected by the clearance sensor 21, is great. When the elastic layer 15*b* of the fixing roller 15 expands as the temperature of the fixing roller 15 increases and thereby the outer diameter of the fixing roller 15 increases, the clearance between the fixing roller 15 and the heating roller 14, which is detected by the clearance sensor 21, is small. That is, the controller 22 calculates an amount of expansion of the fixing roller 15 based on the clearance between the fixing roller 15 and the heating roller 14, which is detected by the clearance sensor 21.

Figure 4:
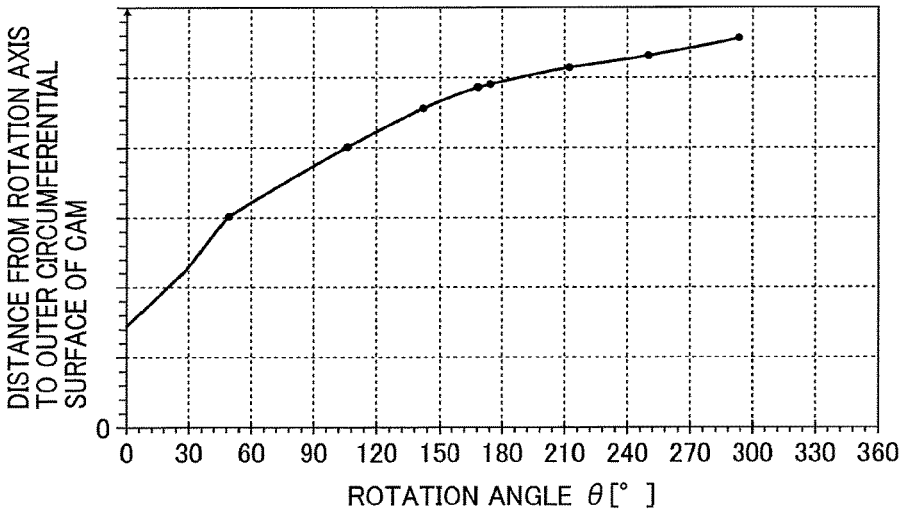
FIG. 4 is a graph illustrating a relation between a rotation angle of a cam and a distance from a rotation axis to an outer circumferential surface of the cam of the fixing device depicted in FIG. 2.

FIG. 4 is a graph illustrating a relation between a rotation angle θ of the cam 18*d* and a distance from a rotation axis (e.g., a center hole) to an outer circumferential surface of the cam 18*d*. As illustrated in FIG. 4, the height of the outer circumferential surface of the cam 18*d*, that is, the distance from the rotation axis to the outer circumferential surface of the cam 18*d*, changes according to the rotation angle θ of the cam 18*d*.

With the fixing device 11 according to this embodiment, when the clearance sensor 21 detects that the clearance between the fixing roller 15 and the heating roller 14 decreases by a predetermined length, for example, the controller 22 calculates an amount of enlargement of the outer diameter of the fixing roller 15 based on the decreased clearance between the fixing roller 15 and the heating roller 14, which is detected by the clearance sensor 21.

The controller 22 determines the amount of movement of the pressure roller 17 in the direction G' in which the pressure roller 17 separates from the fixing roller 15 based on the amount of enlargement of the outer diameter of the fixing roller 15. The controller 22 uniquely calculates an amount of change in the height of the outer circumferential surface of the cam 18*d* from a current position based on the amount of movement of the pressure roller 17. Accordingly, the controller 22 calculates an amount of rotation of the cam 18*d* in the rotation direction E to attain the amount of change in the height of the outer circumferential surface of the cam 18*d*.

As the controller 22 controls the pressure roller mover 18 to rotate the cam 18*d* by the calculated amount of rotation of the cam 18*d*, the pressure roller mover 18 moves the pressure roller 17 in the direction G' in a predetermined amount.

Similarly, if the clearance between the fixing roller 15 and the heating roller 14 increases for a predetermined amount, for example, the controller 22 calculates the amount of movement of the pressure roller 17 in the direction G and the rotation angle of the cam 18*d* based on the amount of movement of the pressure roller 17 in the direction G. The controller 22 controls the pressure roller mover 18 to move the pressure roller 17 in the direction G in the predetermined amount.

Accordingly, the controller 22 adjusts the length of the fixing nip N in the recording medium conveyance direction H appropriately based on the amount of expansion of the fixing roller 15, retaining stable fixing performance. Additionally, under the control method, the controller 22 adjusts the length of the fixing nip N in the recording medium conveyance direction H appropriately, retaining productivity of the fixing device 11. The pressure roller mover 18 moves the pressure roller 17 directly from a pre-movement position to a post-movement position without moving the pressure roller 17 back to a reference position, that is, a default position, so as to move the pressure roller 17 to a desired position, thus adjusting the length of the fixing nip N in the recording medium conveyance direction H readily and quickly and thereby retaining productivity.

A description is provided of a construction of a first comparative fixing device employing a roller fixing method.

The first comparative fixing device includes a fixing roller retained at a predetermined temperature and a pressure roller pressed against the fixing roller to form a fixing nip therebetween. As a recording medium bearing an unfixed toner image is conveyed through the fixing nip while the recording medium is sandwiched between the fixing roller and the pressure roller, the fixing roller and the pressure roller fix the toner image on the recording medium under heat and pressure.

A description is provided of a construction of a second comparative fixing device employing a belt fixing system.

The second comparative fixing device includes a fixing roller, a pressure roller disposed opposite the fixing roller, a heater, a heating roller heated by the heater, and an endless fixing belt stretched taut across the fixing roller and the heating roller. The pressure roller is pressed against the fixing roller via the fixing belt to form a fixing nip between the pressure roller and the fixing belt. As a recording medium bearing an unfixed toner image is conveyed through the fixing nip, the heating roller conducts heat to the recording medium through the fixing belt, thus fixing the toner image on the recording medium under heat and pressure.

A mover moves the pressure roller in a pressing direction in which the pressure roller presses against the fixing roller and a separation direction in which the pressure roller separates from the fixing roller.

In order to attain stable fixing performance by conducting an appropriate amount of heat to the unfixed toner image on the recording medium passing through the fixing nip, a controller is requested to adjust the length of the fixing nip in a recording medium conveyance direction properly.

For example, the controller detects a position of the pressure roller, when a change rate of the temperature of the pressure roller while the pressure roller presses against the fixing roller exceeds a reference value, as a pressing start position where the pressure roller starts pressing against an elastic layer of the fixing roller. Additionally, the controller calculates an amount of movement of the pressure roller from the pressing start position to attain an appropriate length of the fixing nip in the recording medium conveyance direction according to the type of the recording medium. The mover moves the pressure roller toward the fixing roller by the calculated amount of movement of the pressure roller. The temperature of a core bar of the fixing roller is detected. The controller determines whether the fixing roller is in transition or equilibrium thermally based on the detected temperature of the core bar. When the fixing roller is in transition, the controller adjusts the amount of movement of the pressure roller according to expansion of the fixing roller.

However, the controller calculates the amount of movement of the pressure roller from the pressing start position that achieves the appropriate length of the fixing nip in the recording medium conveyance direction. Accordingly, when a plurality of recording media is conveyed through the fixing nip continuously, for example, in order to attain the appropriate amount of movement of the pressure roller, the controller is required to determine the pressing start position after the mover moves the pressure roller from a pressurization position where the pressure roller is pressed against the fixing roller to a separation position where the pressure roller is separated from the fixing roller, degrading productivity.

For example, if the recording medium is an envelope or the like that defines a narrow range from an upper limit to a lower limit of the appropriate length of the fixing nip in the recording medium conveyance direction, the controller is required to adjust the length of the fixing nip in the recording medium conveyance direction for a plurality of times when the plurality of recording media is conveyed through the fixing nip. Accordingly, the controller may take time to adjust the length of the fixing nip in the recording medium conveyance direction for every printing, degrading productivity substantially.

The controller may not adjust the length of the fixing nip in the recording medium conveyance direction if the fixing roller is configured to rotate in accordance with rotation of the pressure roller like the fixing roller 15 that rotates in accordance with rotation of the pressure roller 17. Conversely, the control method performed by the controller 22 is applicable to the fixing device 11 incorporating the fixing roller 15 that rotates in accordance with rotation of the pressure roller 17.

A description is provided of another control method of the fixing device 11.

The controller 22 of the fixing device 11 calculates an amount of adjustment of the length of the fixing nip N in the recording medium conveyance direction H based on the clearance between the fixing roller 15 and the heating roller 14, which is detected by the clearance sensor 21, while no recording medium P is conveyed through the fixing nip N (e.g., an interval between successive recording media P) when a plurality of recording media P is conveyed through the fixing device 11 continuously.

When the recording medium P enters the fixing nip N, pressure exerted to the fixing roller 15 and the pressure roller 17 increases by the thickness of the recording medium P. When pressure exerted to the fixing roller 15 changes, an amount of compression of the elastic layer 15*b* of the fixing roller 15 changes, thus changing the clearance between the fixing roller 15 and the heating roller 14. That is, the clearance between the fixing roller 15 and the heating roller 14 varies depending on the thickness of the recording medium P. Since the recording media P having various thicknesses are conveyed through the fixing device 11, the controller 22 calculates the amount of adjustment of the length of the fixing nip N in the recording medium conveyance direction H based on the clearance between the fixing roller 15 and the heating roller 14 during the interval between successive recording media P when the clearance between the fixing roller 15 and the heating roller 14 is not susceptible to change in the thickness of the recording medium P.

While no recording medium P is conveyed through the fixing nip N (e.g., the interval between successive recording media P) when a plurality of recording media P is conveyed through the fixing device 11 continuously, the controller 22 of the fixing device 11 adjusts the length of the fixing nip N in the recording medium conveyance direction H by rotating the cam 18*d*. If the controller 22 adjusts the length of the fixing nip N in the recording medium conveyance direction H by rotating the cam 18*d* while the recording medium P is conveyed through the fixing nip N, fixing performance may change in fixing the toner image T on an identical page of the recording medium P. To address this circumstance, the controller 22 does not adjust the length of the fixing nip N in the recording medium conveyance direction H while the recording medium P is conveyed through the fixing nip N.

The temperature of the fixing roller 15 when conveyance of the recording medium P through the fixing device 11 starts may vary between a cool state in which the fixing roller 15 is cooled sufficiently and a heated state in which the fixing roller 15 is hot immediately after a previous conveyance of the recording medium P through the fixing device 11 finishes. Hence, the amount of expansion of the elastic layer 15*b* of the fixing roller 15 is not constant when conveyance of the recording medium P starts.

To address this circumstance, the controller 22 of the fixing device 11 determines the amount of movement of the pressure roller 17 based on the clearance between the fixing roller 15 and the heating roller 14 before conveyance of the recording medium P through the fixing device 11 starts, that is, before the recording medium P enters the fixing nip N.

The fixing device 11 according to the embodiments described above adjusts the length of the fixing nip N in the recording medium conveyance direction H appropriately without degrading productivity, retaining stable fixing performance.

A description is provided of a configuration of a fixing device 12 according to a second embodiment.

A description of the configuration of the fixing device 12 that is identical to the configuration of the fixing device 11 according to the first embodiment described above is omitted.

Figure 5:
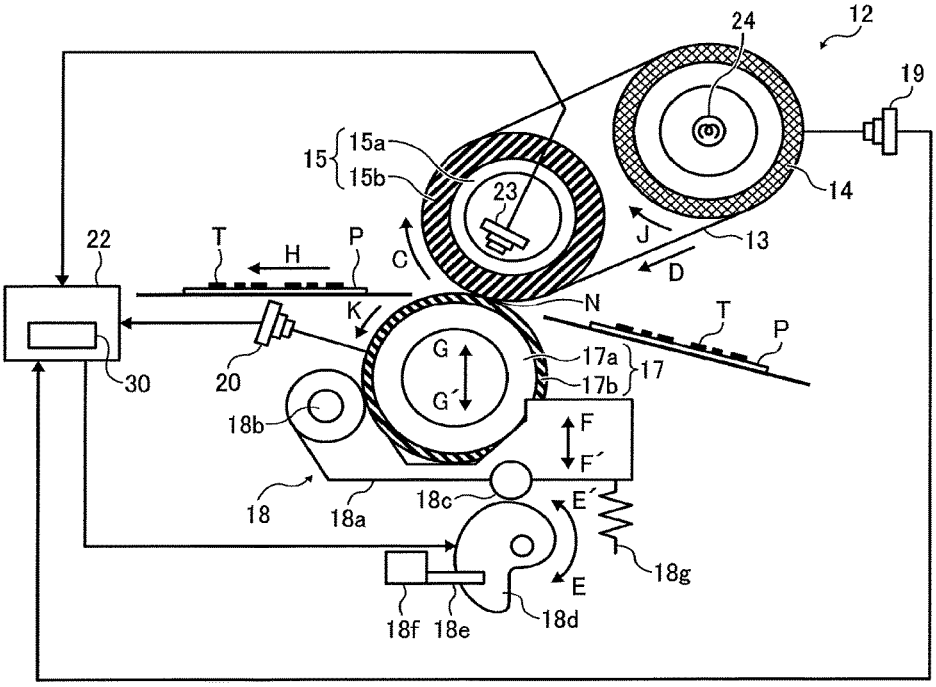
FIG. 5 is a schematic vertical cross-sectional view of a fixing device according to a second embodiment.

As illustrated in FIG. 5, the fixing device 12 (e.g., a fuser or a fusing unit) includes the fixing roller 15, the pressure roller 17, a core bar temperature sensor 23, the pressure roller mover 18, and the controller 22. The fixing roller 15 is constructed of the core bar 15*a* and the elastic layer 15*b* coating the core bar 15*a*. The pressure roller 17 serving as a pressure rotator is pressed against the fixing roller 15 via the fixing belt 13 to form the fixing nip N between the pressure roller 17 and the fixing belt 13. The core bar temperature sensor 23 serving as a core bar temperature detector detects the temperature of the core bar 15*a* of the fixing roller 15. The pressure roller mover 18 serving as a mover moves the pressure roller 17 with respect to the fixing roller 15 in the pressing direction in which the pressure roller 17 presses against the fixing roller 15 via the fixing belt 13 and the separation direction in which the pressure roller 17 separates from the fixing roller 15. A plurality of thresholds is defined for the temperature of the core bar 15*a*. Whenever the temperature of the core bar 15*a* that is detected by the core bar temperature sensor 23 exceeds the thresholds, the controller 22 controls the pressure roller mover 18 to move the pressure roller 17 from the default position in the separation direction in which the pressure roller 17 separates from the fixing roller 15 gradually.

A description is provided of a construction of the fixing device 12 installable in the image forming apparatus 100 depicted in FIG. 1.

FIG. 5 is a schematic vertical cross-sectional view of the fixing device 12 according to the second embodiment. The fixing device 12 employs the belt fixing system incorporating the fixing belt 13 serving as a fixing rotator. In addition to the fixing belt 13, the fixing device 12 includes the heating roller 14, the fixing roller 15, the pressure roller 17, the pressure roller mover 18, the fixing belt temperature sensor 19, the pressure roller temperature sensor 20, the core bar temperature sensor 23, and the controller 22.

The fixing device 12 according to the second embodiment is different from the fixing device 11 according to the first embodiment in that, instead of the clearance sensor 21 incorporated in the fixing device 11, the fixing device 12 includes the core bar temperature sensor 23 that detects the temperature of the core bar 15*a* of the fixing roller 15.

The core bar temperature sensor 23 is situated at a position where the core bar temperature sensor 23 is barely susceptible to heat from the heater 24 disposed inside the fixing device 12 and change in the temperature of the core bar temperature sensor 23 relates to change in the length of the fixing nip N in the recording medium conveyance direction H substantially. For example, the core bar temperature sensor 23 presses against the core bar 15*a* of the fixing roller 15. The core bar temperature sensor 23 is a thermistor or the like that detects the temperature of a surface of the core bar 15*a* directly.

The controller 22 controls the pressure roller mover 18 based on a detection result provided by the core bar temperature sensor 23, thus controlling the position of the pressure roller 17. The controller 22 includes the memory 30 that stores information as needed. The controller 22 may be a controller for the fixing device 12 or a part of a controller that controls the image forming apparatus 100.

A description is provided of a control method of the fixing device 12.

Figure 6:
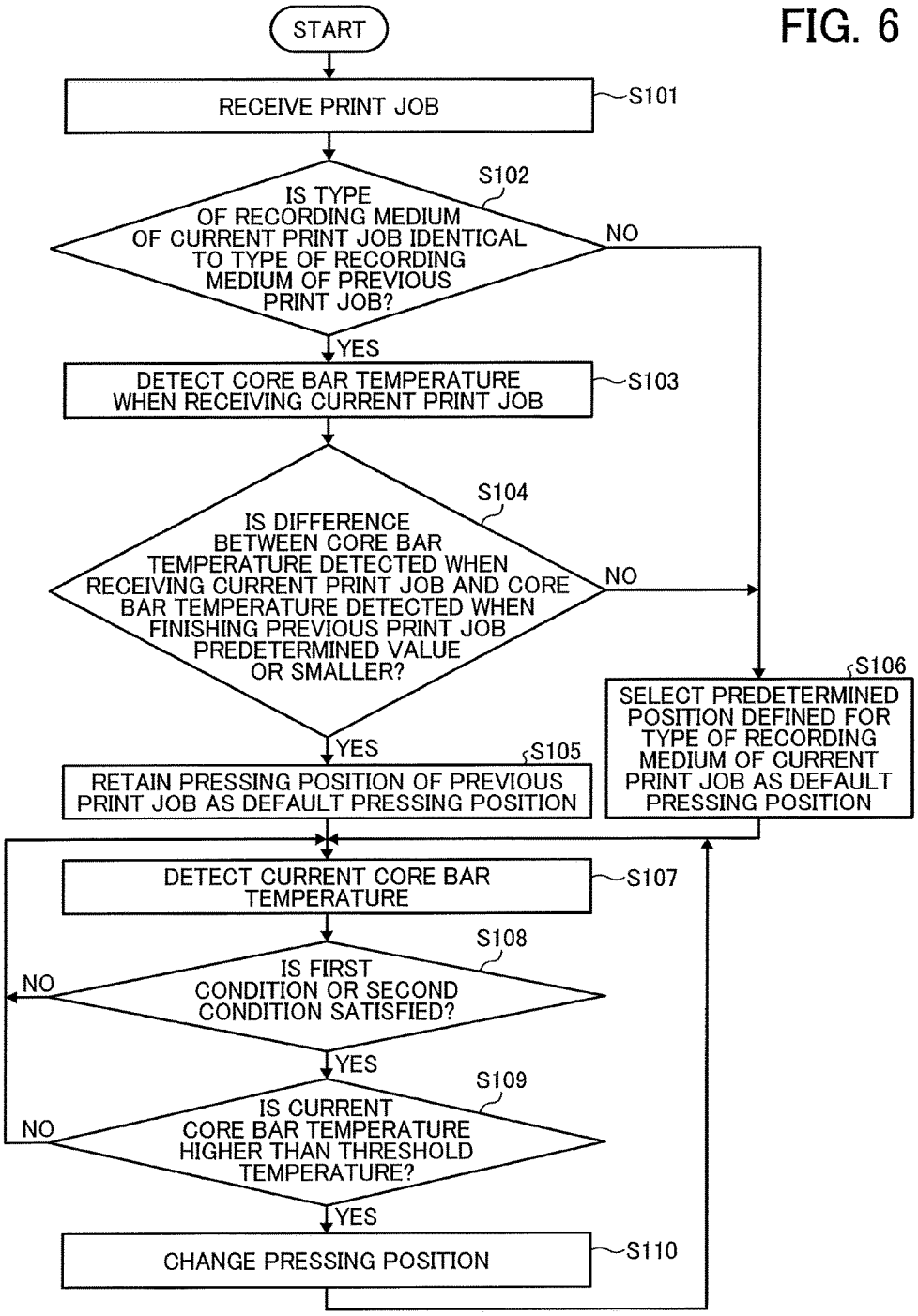
FIG. 6 is a flowchart illustrating one example of a control method for adjusting a length of a fixing nip, which is performed by a controller of the fixing device depicted in FIG. 5.

FIG. 6 is a flowchart illustrating one example of the control method for adjusting the length of the fixing nip N in the recording medium conveyance direction H, which is performed by the controller 22 of the fixing device 12 according to the second embodiment.

The control method for adjusting the length of the fixing nip N in the recording medium conveyance direction H includes processes (e.g., steps S101 to S106) for determining a default pressing position before the recording medium P is conveyed through the fixing device 12. The position of the pressure roller 17, which is changed by the pressure roller mover 18, denotes a pressing position. Various information described below used in the control method for adjusting the length of the fixing nip N in the recording medium conveyance direction H (e.g., the pressing position when a previous print job is finished, the temperature of the core bar 15*a* at each time, and the type of the recording medium P) may be information stored in the memory 30 of the controller 22.

In step S101, as the image forming apparatus 100 receives a job (e.g., a print job), that is, a current print job, the controller 22 reads information about the type of a recording medium P to be conveyed to the fixing device 12.

In step S102, the controller 22 determines whether or not the read type of the recording medium P of the current print job is identical to the type of a recording medium P of a previous print job.

If the type of the recording medium P of the current print job is different from the type of the recording medium P of the previous print job (NO in step S102), the controller 22 selects a predetermined position defined for the type of the recording medium P of the current print job as the default pressing position in step S106. If the controller 22 does not store the type of the recording medium P of the previous print job, for example, when the image forming apparatus 100 is powered on or when the image forming apparatus 100 receives a first print job after the image forming apparatus 100 is turned on in an off sleep mode or the like, the controller 22 selects a predetermined position defined for the type of the recording medium P of the current print job as the default pressing position in step S106.

Conversely, if the type of the recording medium P of the current print job is identical to the type of the recording medium P of the previous print job (YES in step S102), the core bar temperature sensor 23 detects a core bar temperature tj of the core bar 15*a* of the fixing roller 15 when the image forming apparatus 100 receives the current print job in step S103.

In step S104, the controller 22 determines whether or not a difference between the core bar temperature tj of the core bar 15*a* detected when the image forming apparatus 100 receives the current print job and a core bar temperature tb of the core bar 15*a* detected when the previous print job finishes is a predetermined value ts or smaller.

If the difference between the core bar temperature tj and the core bar temperature tb is the predetermined value ts or smaller (YES in step S104), for example, if the type of the recording medium P of the current print job is identical to that of the previous print job and the difference between the core bar temperature tj and the core bar temperature tb is small, the pressing position of the previous print job is retained as the default pressing position in step S105. Thus, the controller 22 secures the appropriate length of the fixing nip N in the recording medium conveyance direction H from a start of the current print job.

Conversely, if the difference between the core bar temperature tj and the core bar temperature tb is not the predetermined value ts or smaller (NO in step S104), the controller 22 selects the predetermined position defined for the type of the recording medium P of the current print job as the default pressing position in step S106.

In steps S101 to S106 for determining the default pressing position, when a substantial time passes after the previous print job finishes and the fixing roller 15 dissipates heat, a relation between the temperature of the core bar 15*a* of the fixing roller 15 and the amount of thermal expansion of the fixing roller 15 may lose balance and thermal expansion of the fixing roller 15 may not progress relative to the temperature of the core bar 15*a*. In this case, if the controller 22 controls the position of the pressure roller 17 based on the detected temperature of the core bar 15*a* of the fixing roller 15, the appropriate length of the fixing nip N in the recording medium conveyance direction H may not be obtained, resulting in fixing failure. To address this circumstance, in addition to a case in which the type of the recording medium P of the current print job is different from that of the previous print job, in a case in which the image forming apparatus 100 is powered on immediately before the current print job, in a case in which the current print job is the first print job after the image forming apparatus 100 is turned on in the off sleep mode or the like, or in a case in which the difference between the core bar temperature tj and the core bar temperature tb is great, the controller 22 selects the predetermined position defined for the type of the recording medium P of the current print job as the default pressing position.

A description is provided of processes (e.g., steps S107 to S110) performed when a plurality of recording media P is conveyed through the fixing device 12 continuously.

In step S107, when the plurality of recording media P is conveyed through the fixing device 12, the core bar temperature sensor 23 detects a current core bar temperature to of the core bar 15*a* of the fixing roller 15 in a predetermined control cycle. The predetermined control cycle is not limited. For example, the predetermined control cycle is 400 msec or the like.

In step S108, the controller 22 determines whether or not a first condition or a second condition is satisfied. The first condition is that a predetermined time Tj (e.g., a predetermined excluded time) has elapsed after the image forming apparatus 100 receives the current print job. The second condition is that a difference between the current core bar temperature tn and the core bar temperature tj when the image forming apparatus 100 receives the current print job is a predetermined temperature Δt or greater. That is, the controller 22 determines whether or not a formula (1) below is satisfied.

$$tn-tj \geq \Delta t \quad (1)$$

Before one of the first condition and the second condition is satisfied (NO in step S108), the controller 22 starts a control excluded time when the controller 22 does not change the pressing position of the pressure roller 17 while the plurality of recording media P is conveyed through the fixing device 12.

Conversely, if one of the first condition and the second condition is satisfied (YES in step S108), the controller 22 finishes the control excluded time. While no recording medium P is conveyed through the fixing nip N, that is, during an interval between successive recording media P, the controller 22 determines whether or not the current core bar temperature tn is higher than a threshold temperature ti (i=1, 2, 3, . . . ) in step S109.

If the current core bar temperature tn is higher than the threshold temperature ti (YES in step S109), the controller 22 changes the pressing position of the pressure roller 17 from the default pressing position stepwise by a pressing position decrease amount Ai (i=1, 2, 3, . . . ) in step S110. The threshold temperature ti and the pressing position decrease amount Ai are determined for each type of the recording media P.

The control excluded time allows the controller 22 to perform control appropriately even if a pre-condition before the current print job is unclear, preventing fixing failure. If the pre-condition before the current print job is clear, the controller 22 refers to information about the previous print job to adjust the length of the fixing nip N in the recording medium conveyance direction H appropriately without the control excluded time.

Even after the controller 22 changes the pressing position of the pressure roller 17, the controller 22 determines whether or not the current core bar temperature tn is higher than the threshold temperature ti repeatedly. Whenever the current core bar temperature tn exceeds the threshold temperature ti, the controller 22 changes the pressing position of the pressure roller 17 from the default pressing position in the separation direction in which the pressure roller 17 separates from the fixing roller 15 stepwise by the pressing position decrease amount Ai. Under the control method described above, the controller 22 does not move the pressure roller 17 toward the fixing roller 15 while the plurality of recording media P is conveyed through the fixing device 12 continuously but does move the pressure roller 17 constantly in the separation direction in which the pressure roller 17 separates from the fixing roller 15.

Figure 7:
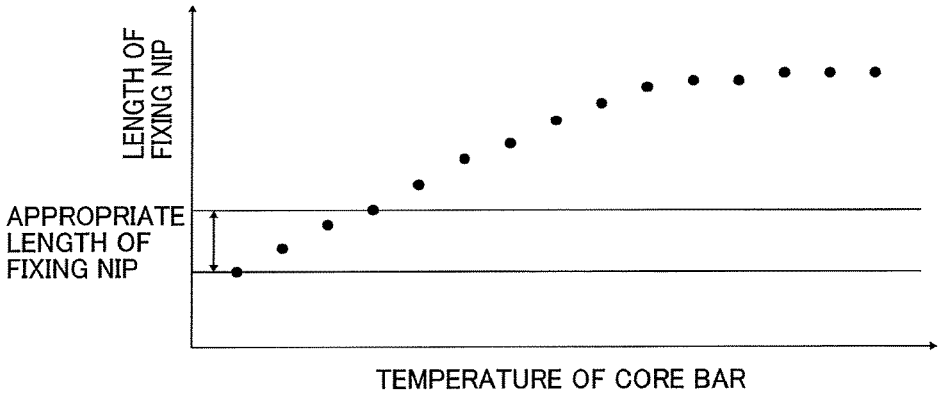
FIG. 7 is a graph illustrating a relation between a temperature of a core bar of the fixing roller and a length of the fixing nip of the fixing device depicted in FIG. 5.

FIG. 7 is a graph illustrating a relation between the temperature of the core bar 15*a* of the fixing roller 15 and the length of the fixing nip N in the recording medium conveyance direction H. As illustrated in FIG. 7, as the temperature of the core bar 15*a* increases, the length of the fixing nip N in the recording medium conveyance direction H increases to a faulty length greater than an appropriate length. If the length of the fixing nip N in the recording medium conveyance direction H increases to the faulty length, conveyance of the recording medium P and quality of the toner image T fixed on the recording medium P may degrade.

Figure 8:
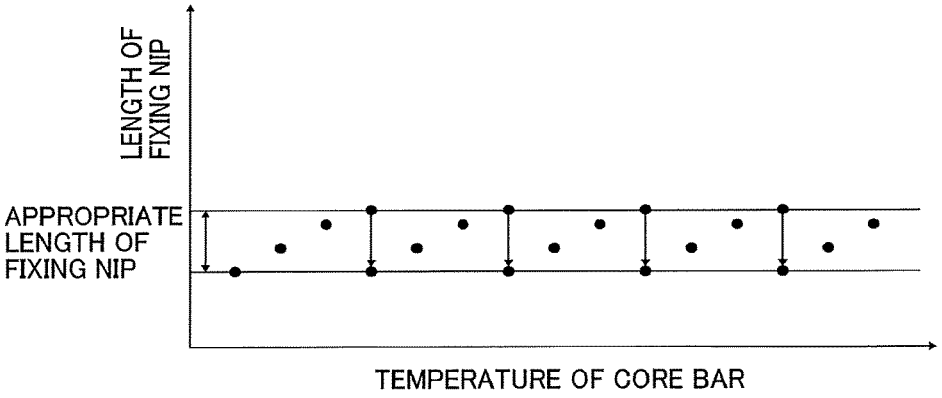
FIG. 8 is a graph illustrating the relation between the temperature of the core bar of the fixing roller and the length of the fixing nip of the fixing device depicted in FIG. 5, illustrating one example of the control method for adjusting the length of the fixing nip.

FIG. 8 is a graph illustrating the relation between the temperature of the core bar 15*a* of the fixing roller 15 and the length of the fixing nip N in the recording medium conveyance direction H. FIG. 8 illustrates an example of the above-described control method for adjusting the length of the fixing nip N in the recording medium conveyance direction H. As illustrated in FIG. 8, even if the length of the fixing nip N in the recording medium conveyance direction H increases as the temperature of the core bar 15*a* increases, when the length of the fixing nip N in the recording medium conveyance direction H is near an upper limit of the appropriate length of the fixing nip N, the controller 22 changes the pressing position of the pressure roller 17 in the separation direction in which the pressure roller 17 separates from the fixing roller 15 stepwise by the pressing position decrease amount Ai. Thus, the controller 22 adjusts the length of the fixing nip N in the recording medium conveyance direction H again to a length near a lower limit of the appropriate length of the fixing nip N.

Accordingly, whenever the length of the fixing nip N in the recording medium conveyance direction H is near the upper limit of the appropriate length of the fixing nip N, the controller 22 adjusts the pressing position of the pressure roller 17. Consequently, even if the temperature of the core bar 15*a* increases, that is, even if the fixing roller 15 expands thermally, the controller 22 retains the appropriate length of the fixing nip N constantly.

The controller 22 does not detect the length of the fixing nip N in the recording medium conveyance direction H directly while the recording medium P is conveyed through the fixing device 12. Hence, the controller 22 calculates the relation between the temperature of the core bar 15*a* and the length of the fixing nip N in the recording medium conveyance direction H in advance and calculates the temperature of the core bar 15*a* that corresponds nearly to the upper limit of the appropriate length of the fixing nip N in the recording medium conveyance direction H, that is, the threshold temperature ti, for each type of the recording media P. Accordingly, the controller 22 performs the control method whenever the current core bar temperature to exceeds the threshold temperature ti while the recording medium P is conveyed through the fixing device 12, thus retaining the appropriate length of the fixing nip N in the recording medium conveyance direction H constantly.

A description is provided of activation of the control method for adjusting the length of the fixing nip N in the recording medium conveyance direction H during the interval between the successive recording media P.

Table 1 illustrates the interval between the successive recording media P obtained at each of four productivities when recording media P having an A4 size in landscape orientation are conveyed through the fixing device 12 at a linear velocity of 300 mm/sec.

TABLE 1

| Length of recording medium (mm) | Linear velocity (mm/sec) | Productivity (sheets/min) | Linear velocity (mm/sec) | Clearance (mm) | Interval (msec) |
|---|---|---|---|---|---|
| 210 | 300 | 20 | 300 | 690 | 2300 |
| | | 40 | 300 | 240 | 800 |
| | | 60 | 300 | 90 | 300 |
| | | 80 | 300 | 15 | 50 |

As illustrated in Table 1, when the recording media P are conveyed at a productivity of 60 sheets per minute, for example, the recording media P are conveyed with an interval of 300 msec. When the recording media P are conveyed at a productivity of 80 sheets per minute, the recording media P are conveyed with an interval of 50 msec. If it takes a change time in a range of from about 50 msec to about 100 msec to change the pressing position of the pressure roller 17 so as to change the length of the fixing nip N in the recording medium conveyance direction H by 1 mm during conveyance of the recording media P, the controller 22 adjusts the pressing position of the pressure roller 17 during the interval between the successive recording media P under a productivity of about 60 sheets per minute.

Conversely, under a productivity of 80 sheets per minute, since the interval between the successive recording media P is shorter than the change time to change the pressing position of the pressure roller 17, the recording medium P may enter the fixing nip N while the controller 22 changes the pressing position of the pressure roller 17. To address this circumstance, the controller 22 determines whether or not the interval between the successive recording media P is shorter than the change time to change the pressing position of the pressure roller 17. If the controller 22 determines that the interval between the successive recording media P is shorter than the change time to change the pressing position of the pressure roller 17, the controller 22 increases the interval between the successive recording media P temporarily. Accordingly, while the controller 22 changes the pressing position of the pressure roller 17, the recording medium P does not enter the fixing nip N. The change time to change the pressing position of the pressure roller 17 may be any value stored in advance.

The fixing device 12 according to the second embodiment described above adjusts the length of the fixing nip N in the recording medium conveyance direction H during the interval between the successive recording media P based on the temperature of the core bar 15*a* of the fixing roller 15, thus retaining the appropriate length of the fixing nip N in the recording medium conveyance direction H without degrading productivity. Additionally, the controller 22 sets the appropriate threshold according to the type of the recording medium P, retaining the appropriate length of the fixing nip N in the recording medium conveyance direction H for each of various types of the recording media P.

A description is provided of a configuration of the fixing device 12 according to a third embodiment.

As described above, recording media P that are susceptible to creasing and fixing failure, such as an envelope, define a restricted range of the length of the fixing nip N in the recording medium conveyance direction H, which satisfies both of image quality (e.g., a fixing property to fix the toner image T on the recording medium P) and conveyance quality (e.g., a conveyance property to convey the recording medium P). Hence, when thermal expansion of the fixing roller 15 generates a change in the length of the fixing nip N in the recording medium conveyance direction H, the controller 22 is requested to eliminate the change and adjust the length of the fixing nip N in the recording medium conveyance direction H appropriately.

As an example of the second embodiment described above, the core bar temperature sensor 23 detects the temperature of the core bar 15*a* of the fixing roller 15. The controller 22 predicts the amount of thermal expansion of the fixing roller 15 and the length of the fixing nip N in the recording medium conveyance direction H based on the detected temperature of the core bar 15*a*. The controller 22 controls the pressure roller mover 18 to move the pressure roller 17 stepwise, thus adjusting the length of the fixing nip N in the recording medium conveyance direction H.

However, as described above, the relation between the temperature of the core bar 15*a* of the fixing roller 15 and the amount of thermal expansion of the fixing roller 15 is not constant and therefore fluctuates under a predetermined condition. For example, in a process in which the fixing roller 15 is heated and then cooled, it takes time for the temperature of the core bar 15*a* to decrease. Conversely, since the outer circumferential surface of the fixing roller 15 is cooled faster than an interior of the fixing roller 15 and facilitates heat shrink, an actual amount of thermal expansion of the fixing roller 15 is smaller than a predicted amount of thermal expansion of the fixing roller 15, which is predicted based on the temperature of the core bar 15*a*.

If the relation between the temperature of the core bar 15*a* of the fixing roller 15 and the amount of thermal expansion of the fixing roller 15 is outside a predicted relation, even if the controller 22 adjusts the length of the fixing nip N in the recording medium conveyance direction H based on the predicted relation, the controller 22 may not attain a desired length of the fixing nip N in the recording medium conveyance direction H, resulting in fixing failure and conveyance failure during conveyance of the recording medium P.

To address this circumstance, the fixing device 12 according to the third embodiment includes the fixing roller 15, the pressure roller 17, the core bar temperature sensor 23, the pressure roller mover 18, and the controller 22. The fixing roller 15 is constructed of the core bar 15*a* and the elastic layer 15*b* coating the core bar 15*a*. The pressure roller 17 serving as a pressure rotator is pressed against the fixing roller 15 via the fixing belt 13 to form the fixing nip N between the pressure roller 17 and the fixing belt 13. The core bar temperature sensor 23 serving as a core bar temperature detector detects the temperature of the core bar 15*a* of the fixing roller 15. The pressure roller mover 18 serving as a mover moves the pressure roller 17 with respect to the fixing roller 15 in the pressing direction in which the pressure roller 17 presses against the fixing roller 15 via the fixing belt 13 and the separation direction in which the pressure roller 17 separates from the fixing roller 15.

The controller 22 controls the pressure roller mover 18 to move the pressure roller 17 based on the temperature of the core bar 15*a* of the fixing roller 15, which is detected by the core bar temperature sensor 23, during conveyance of the recording medium P. The controller 22 determines a heat storage state of the fixing device 12 after the image forming apparatus 100 receives a job (e.g., a print job) and before a recording medium P is conveyed through the fixing device 12. The controller 22 performs a heat storage and rotation control to control an amount of heat stored by the fixing device 12 (e.g., the fixing roller 15) and the amount of rotation of the cam 18*d* based on the determined heat storage state. The heat storage and rotation control is also called a heat storage and movement control to control the amount of heat stored by the fixing device 12 and the amount of movement of the pressure roller 17 moved by the pressure roller mover 18.

For example, under a condition in which the relation between the temperature of the core bar 15*a* of the fixing roller 15 and the amount of thermal expansion of the fixing roller 15 changes from the predicted relation, the controller 22 performs the heat storage and rotation control, thus causing the relation between the temperature of the core bar 15*a* and the amount of thermal expansion of the fixing roller 15 to be close to the predicted relation.

Figure 9:
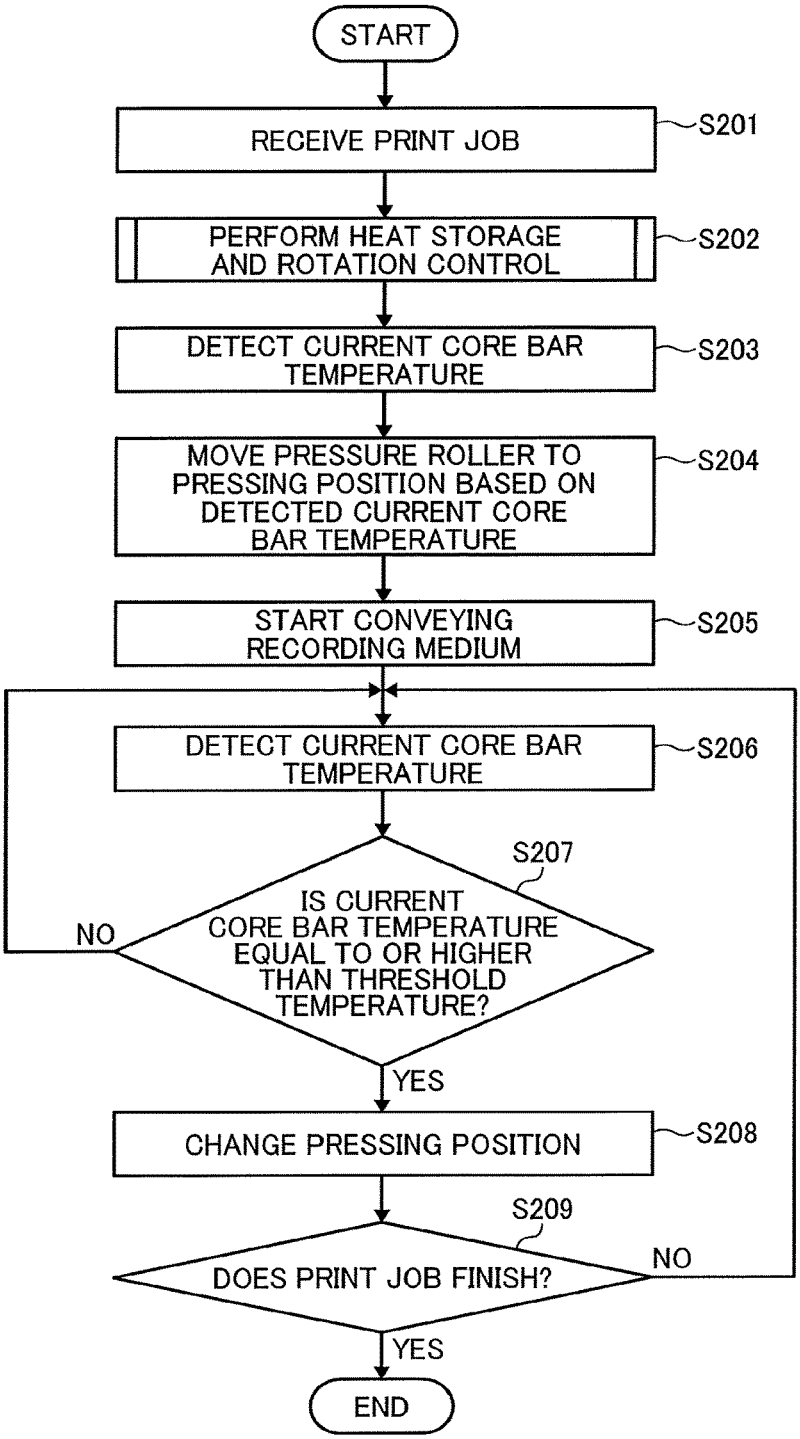
FIG. 9 is a flowchart illustrating one example of the control method for adjusting the length of the fixing nip, which is performed by the controller of the fixing device depicted in FIG. 5 according to a third embodiment.

FIG. 9 is a flowchart illustrating one example of the control method for adjusting the length of the fixing nip N in the recording medium conveyance direction H, which is performed by the controller 22 of the fixing device 12 according to the third embodiment. The control method for adjusting the length of the fixing nip N in the recording medium conveyance direction H illustrated in FIG. 9 may involve one or more processes depicted in FIG. 6 or described above in the first embodiment and the second embodiment.

The control method for adjusting the length of the fixing nip N in the recording medium conveyance direction H according to the third embodiment includes processes (e.g., steps S201 to S204) for determining the default pressing position before the recording medium P is conveyed through the fixing device 12.

In step S201, the image forming apparatus 100 receives a job (e.g., a print job).

In step S202, the controller 22 performs the heat storage and rotation control. A detailed description of the heat storage and rotation control is deferred.

In step S203, the core bar temperature sensor 23 detects the current core bar temperature tn of the core bar 15*a* of the fixing roller 15. The core bar temperature sensor 23 detects the current core bar temperature tn when a recording medium P is fed from a paper tray of the image forming apparatus 100, for example.

In step S204, the controller 22 causes the pressure roller mover 18 to move the pressure roller 17 to the pressing position as the default pressing position based on the detected current core bar temperature tn.

A description is provided of processes (e.g., steps S205 to S209) performed when a plurality of recording media P is conveyed through the fixing device 12 continuously.

In step S205, the controller 22 starts conveyance of the recording medium P through the fixing device 12.

After conveyance of the recording medium P starts in step S205, the core bar temperature sensor 23 detects the current core bar temperature tn in the predetermined control cycle in step S206. The predetermined control cycle is not limited. For example, the predetermined control cycle is 400 msec or the like.

While no recording medium P is conveyed through the fixing nip N, that is, during the interval between the successive recording media P, the controller 22 determines whether or not the current core bar temperature tn is equal to or higher than the threshold temperature ti (i=1, 2, 3, . . . ) in step S207.

If the current core bar temperature tn is equal to or higher than the threshold temperature ti (YES in step S207), the controller 22 changes the pressing position of the pressure roller 17 from the default pressing position stepwise by the pressing position decrease amount Ai (i=1, 2, 3, . . . ) in step S208. The threshold temperature ti and the pressing position decrease amount Ai are determined for each type of the recording media P.

In step S209, the controller 22 determines whether or not the print job finishes.

Even after the controller 22 changes the pressing position of the pressure roller 17, the controller 22 performs the above-described processes repeatedly until the print job finishes (YES in step S209).

The controller 22 determines whether or not the current core bar temperature tn is equal to or higher than the threshold temperature ti. Whenever the current core bar temperature tn exceeds the threshold temperature ti, the controller 22 changes the pressing position of the pressure roller 17 from the default pressing position in the separation direction in which the pressure roller 17 separates from the fixing roller 15 stepwise by the pressing position decrease amount Ai. Under the control method described above, the controller 22 does not move the pressure roller 17 toward the fixing roller 15 while the plurality of recording media P is conveyed through the fixing device 12 continuously but does move the pressure roller 17 constantly in the separation direction in which the pressure roller 17 separates from the fixing roller 15.

Accordingly, as described above with reference to FIGS. 7 and 8, whenever the length of the fixing nip N in the recording medium conveyance direction H is near the upper limit of the appropriate length of the fixing nip N, the controller 22 adjusts the pressing position of the pressure roller 17. Consequently, even if the temperature of the core bar 15*a* increases, that is, even if the fixing roller 15 expands thermally, the controller 22 retains the appropriate length of the fixing nip N in the recording medium conveyance direction H according to increase in the temperature of the core bar 15*a*.

A detailed description is now given of the heat storage and rotation control in step S202.

Figure 10:
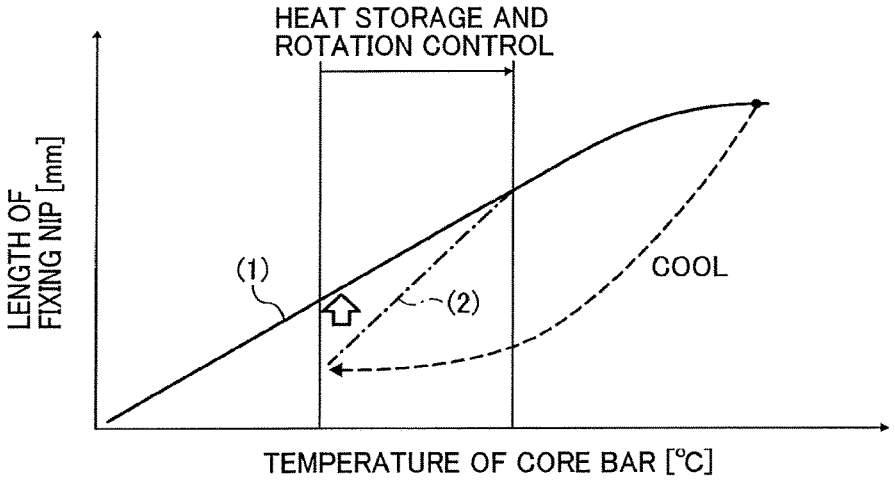
FIG. 10 is a graph illustrating one example of the relation between the temperature of the core bar of the fixing roller and the length of the fixing nip of the fixing device according to the third embodiment.

FIG. 10 is a graph illustrating one example of the relation between the temperature of the core bar 15*a* of the fixing roller 15 and the length of the fixing nip N in the recording medium conveyance direction H.

Referring to FIG. 10, a description is provided of objectives of the heat storage and rotation control.

If a recording medium P is conveyed through the fixing nip N while the fixing roller 15 is heated, the relation between the temperature of the core bar 15*a* and the length of the fixing nip N in the recording medium conveyance direction H defines a line (1) in FIG. 10. Conversely, if a recording medium P is conveyed through the fixing nip N while the fixing roller 15 is cooled temporarily after the fixing roller 15 expands thermally, the relation between the temperature of the core bar 15*a* and the length of the fixing nip N in the recording medium conveyance direction H defines a line (2) in FIG. 10. Thus, the line (2) deviates from the line (1).

If the line (2) indicating the relation between the temperature of the core bar 15*a* and the length of the fixing nip N in the recording medium conveyance direction H deviates from a predicted relation indicated by the line (1), the control method for adjusting the length of the fixing nip N in the recording medium conveyance direction H may not attain the desired length of the fixing nip N in the recording medium conveyance direction H, adversely affecting quality of the toner image T formed on the recording medium P and performance of conveyance of the recording medium P.

To address this circumstance, the heat storage and rotation control adjusts a process performed according to the relation indicated by the line (2) to a process performed according to the relation indicated by the line (1) in a cooling process. Thus, the control method for adjusting the length of the fixing nip N in the recording medium conveyance direction H attains the desired length of the fixing nip N in the recording medium conveyance direction H.

Figure 11:
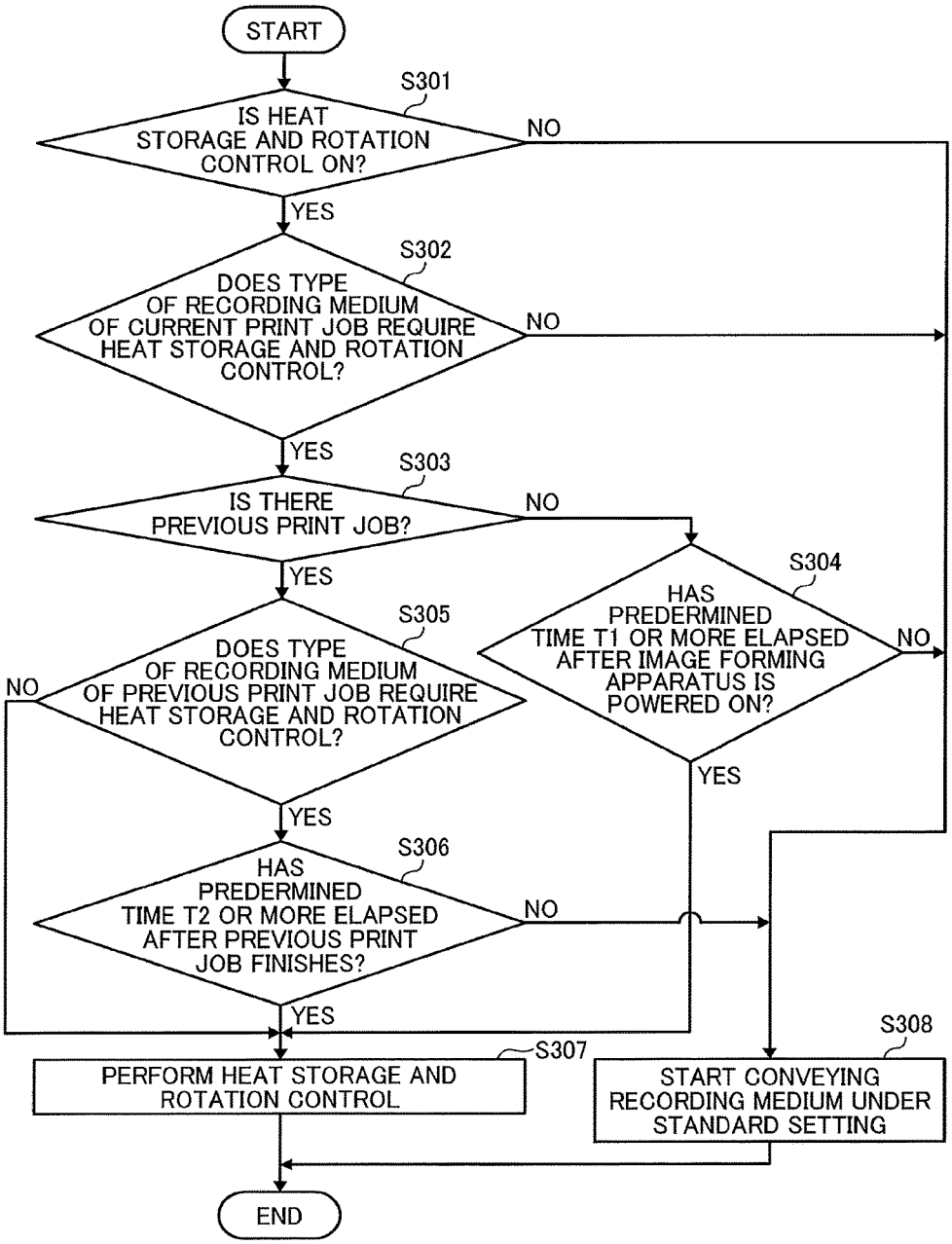
FIG. 11 is a flowchart illustrating one example of a heat storage and rotation control performed by the fixing device according to the third embodiment.

FIG. 11 is a flowchart illustrating one example of the heat storage and rotation control.

In step S301, the controller 22 determines whether or not the heat storage and rotation control is on or off. For example, a user turns on and off the heat storage and rotation control with a switch, a control panel, or the like. The controller 22 determines whether or not the user has turned on the heat storage and rotation control. Since the user turns on and off the heat storage and rotation control, if the user does not wish to wait before a print job starts, that is, if the user prefers a print speed, the user turns off the heat storage and rotation control.

If the heat storage and rotation control is turned on (YES in step S301), the controller 22 determines whether or not the type of a recording medium P of a current print job is a predetermined type that requires the heat storage and rotation control in step S302.

Conversely, if the heat storage and rotation control is turned off (NO in step S301), the controller 22 does not perform the heat storage and rotation control and starts conveying the recording medium P under a standard setting in step S308.

For example, in step S302, the controller 22 determines whether or not the recording medium P is an envelope. Since the envelope decreases the length of the fixing nip N in the recording medium conveyance direction H compared to plain paper, in order to form a high quality toner image T on the envelope, the controller 22 is requested to adjust the length of the fixing nip N in the recording medium conveyance direction H appropriately by checking thermal expansion of the fixing roller 15 precisely. To address this request, if the recording medium P is the envelope, after the image forming apparatus 100 receives the print job and before the envelope is conveyed through the fixing nip N, the controller 22 performs the heat storage and rotation control until the controller 22 predicts thermal expansion of the fixing roller 15 based on the temperature of the core bar 15*a*. The predetermined type of the recording medium P that requires the heat storage and rotation control may be any type that is preset.

If the recording medium P has the type that requires the heat storage and rotation control (YES in step S302), the controller 22 determines whether or not there is a previous print job before the current print job in step S303.

The controller 22 determines in which process the heat storage state of the fixing device 12 is, a thermal expansion process or a cooling process, by determining whether or not there is the previous print job. Conversely, if the recording medium P has a type that does not require the heat storage and rotation control (NO in step S302), the controller 22 does not perform the heat storage and rotation control and starts conveying the recording medium P under the standard setting in step S308.

If the previous print job is absent (NO in step S303), the controller 22 determines whether or not a predetermined time t1 [second] or more has elapsed after the image forming apparatus 100 is powered on in step S304. Since the image forming apparatus 100 is warmed up when the image forming apparatus 100 is powered on, the fixing device 12 is in the thermal expansion process immediately after the image forming apparatus 100 is powered on.

Accordingly, if the predetermined time t1 has not elapsed after the image forming apparatus 100 is powered on (NO in step S304), the controller 22 determines that the fixing device 12 is in the thermal expansion process and does not perform the heat storage and rotation control in step S308.

Conversely, if the predetermined time t1 or more has elapsed after the image forming apparatus 100 is powered on (YES in step S304), the controller 22 determines that the fixing device 12 is in the cooling process and performs the heat storage and rotation control in step S307.

As described above, the controller 22 determines in which state the fixing device 12 is, the cooling process or the thermal expansion process, based on an elapsed time elapsed after the image forming apparatus 100 is powered on until the image forming apparatus 100 receives the print job. If the fixing device 12 is in the cooling process, the controller 22 performs the heat storage and rotation control according to the heat storage state of the fixing device 12.

If there is the previous print job (YES in step S303), the controller 22 determines whether or not the type of a recording medium P of the previous print job requires the heat storage and rotation control, that is, whether or not to perform the heat storage and rotation control based on the type of a recording medium P of the previous print job in step S305. A preset fixing temperature varies depending on the type of the recording medium P. Accordingly, if the preset fixing temperature for the recording medium P of the previous print job is high, the fixing device 12 stores heat sufficiently. Conversely, if the preset fixing temperature for the recording medium P of the previous print job is low, the fixing device 12 stores heat insufficiently. Since the controller 22 determines whether or not the fixing device 12 stores heat sufficiently according to the type of the recording medium P of the previous print job, the controller 22 determines whether or not to perform the heat storage and rotation control.

For example, according to this embodiment, in step S305, the controller 22 determines whether or not the recording medium P of the previous print job is an envelope. Since the envelope is more susceptible to creasing than plain paper, the length of the fixing nip N in the recording medium conveyance direction H decreases when the envelope is conveyed through the fixing nip N. Instead, the preset fixing temperature increases for the envelope so that the fixing device 12 applies heat to toner of a toner image T formed on the envelope in an amount great enough to fix the toner image T on the envelope. Accordingly, if the recording medium P of the previous print job is the envelope, the controller 22 determines that the fixing device 12 stores heat sufficiently.

If the recording medium P of the previous print job is the envelope (YES in step S305), the controller 22 determines whether or not a predetermined time t2 [second] or more has elapsed after the previous print job finishes in step S306.

If the predetermined time t2 or more has elapsed after the previous print job finishes (YES in step S306), the controller 22 determines that the fixing device 12 is in the cooling process and performs the heat storage and rotation control in step S307.

Conversely, if the predetermined time t2 or more has not elapsed after the previous print job finishes (NO in step S306), the controller 22 determines that the fixing device 12 is in the thermal expansion process and does not perform the heat storage and rotation control in step S308.

If the recording medium P of the previous print job is not the envelope (NO in step S305), the controller 22 performs the heat storage and rotation control regardless of an elapsed time elapsed after the previous print job finishes.

As described above, the controller 22 determines in which state the fixing device 12 is, the cooling process or the thermal expansion process, based on the elapsed time elapsed after the previous print job finishes until the image forming apparatus 100 receives the current print job. If the fixing device 12 is in the cooling process, the controller 22 performs the heat storage and rotation control according to the heat storage state of the fixing device 12.

In step S307, the controller 22 starts conveying the recording medium P after performing the heat storage and rotation control for a control time t3 [second] that varies depending on the type (e.g., the brand of paper) of the recording medium P of the current print job. Table 2 lists an example of the control time t3 for which the heat storage and rotation control is performed, which is set for each type of the recording media P.

TABLE 2

| Category of recording medium | t3 [second] | Length of fixing nip |
|---|---|---|
| Category 1 | 0 | Great |
| Category 2 | 180 | Medium |
| Category 3 | 360 | Small |

As illustrated in Table 2, with the recording media P of categories 1 and 2 for which the length of the fixing nip N in the recording medium conveyance direction H is great or medium, the relation between the temperature of the core bar 15*a* and the length of the fixing nip N in the recording medium conveyance direction H is allowed to deviate from a desired relation slightly. Hence, the controller 22 does not perform the heat storage and rotation control for the recording medium P of category 1 or the controller 22 performs the heat storage and rotation control for a shortened time for the recording medium P of category 2. Conversely, the controller 22 performs the heat storage and rotation control for a sufficient time for the recording medium P of category 3 for which the length of the fixing nip N in the recording medium conveyance direction H is small until the desired relation is attained. Thus, the controller 22 selects the appropriate control time t3 of the heat storage and rotation control, which varies depending on the brand of paper.

With the fixing device 12 according to the third embodiment described above, if the controller 22 determines that the fixing device 12 immediately before conveyance of the recording medium P is in the cooling process and that the relation between the temperature of the core bar 15*a* and thermal expansion of the fixing roller 15 deviates from the desired relation, the controller 22 performs the heat storage and rotation control to restore the desired relation. The controller 22 precisely predicts the amount of thermal expansion of the fixing roller 15 and the length of the fixing nip N in the recording medium conveyance direction H based on the detected temperature of the core bar 15*a*. Thus, the controller 22 adjusts the length of the fixing nip N in the recording medium conveyance direction H appropriately.

When the controller 22 performs the heat storage and rotation control, if the recording medium P to be conveyed through the fixing nip N is paper of a brand for which the controller 22 determines that the length of the fixing nip N in the recording medium conveyance direction H, which attains both conveying performance to convey the recording medium P and fixing performance to fix the toner image T on the recording medium P, is small, the controller 22 spares a time for heat storage and rotation before conveyance of the recording medium P to the fixing nip N.

If the controller 22 determines that the fixing roller 15 stores heat insufficiently in the previous print job, the controller 22 spares the time for heat storage and rotation before conveyance of the recording medium P to the fixing nip N.

If the controller 22 determines that the elapsed time elapsed after the previous print job finishes until the image forming apparatus 100 receives the current print job is long and that the fixing device 12 is in the cooling process, the controller 22 spares the time for heat storage and rotation.

If the controller 22 determines that the elapsed time elapsed after the image forming apparatus 100 is powered on until the image forming apparatus 100 receives the print job is long and that the fixing device 12 is in the cooling process, the controller 22 spares the time for heat storage and rotation.

Accordingly, regardless of the type of the recording medium P conveyed through the fixing nip N and the heat storage state of the fixing device 12, the controller 22 retains the length of the fixing nip N in the recording medium conveyance direction H, which stably assures quality of fixing the toner image T on the recording medium P and quality of conveying the recording medium P.

A description is provided of a configuration of the fixing device 12 according to a fourth embodiment.

With the fixing device 12 depicted in FIG. 5, the controller 22 controls the pressure roller mover 18 to move the pressure roller 17 to a desired position. With the fixing device 11 according to the first embodiment depicted in FIG. 2, the pressure roller mover 18 moves the pressure roller 17 directly from the pre-movement position to the post-movement position without moving the pressure roller 17 back to the reference position so as to move the pressure roller 17 to the desired position as one example. Alternatively, the controller 22 may control the pressure roller mover 18 differently. For example, the controller 22 adjusts a rotation time or the like for which the cam 18*d* rotates from the reference position, thus moving the pressure roller 17 to the desired position.

According to the third embodiment, under the condition in which the relation between the temperature of the core bar 15*a* of the fixing roller 15 and the amount of thermal expansion of the fixing roller 15 changes from the predicted relation, the controller 22 performs the heat storage and rotation control before the recording medium P is conveyed through the fixing nip N, thus causing the relation between the temperature of the core bar 15*a* and the amount of thermal expansion of the fixing roller 15 to restore the predicted relation.

The fixing device 12 may not be immune from machining errors such as variation in the outer diameter and the hardness of the fixing roller 15 and variation in the dimension of the cam 18*d* of the pressure roller mover 18. Accordingly, even if the pressure roller 17 is positioned under an identical condition of control (e.g., the rotation time of the cam 18*d*) for a plurality of fixing devices 12, the length of the fixing nip N in the recording medium conveyance direction H may vary. If the controller 22 does not attain the desired length of the fixing nip N in the recording medium conveyance direction H, the fixing device 12 may suffer from fixing failure and conveyance failure during conveyance of the recording medium P.

To address this circumstance, according to the fourth embodiment, in view of machining errors of the components and the like of the fixing device 12 between units or lots, the controller 22 performs a control to eliminate machining errors (hereinafter referred to as a correction control between devices). Accordingly, regardless of the lots of the fixing devices 12, the controller 22 retains the length of the fixing nip N in the recording medium conveyance direction H, which stably assures quality of fixing the toner image T on the recording medium P and quality of conveying the recording medium P.

The correction control between devices according to the fourth embodiment is preferably performed together with the heat storage and rotation control according to the third embodiment. A combination of the correction control between devices and the heat storage and rotation control to adjust the length of the fixing nip N in the recording medium conveyance direction H appropriately retains the length of the fixing nip N in the recording medium conveyance direction H, which stably assures quality of fixing the toner image T on the recording medium P and quality of conveying the recording medium P, regardless of the lot of the fixing device 12, the type of the recording medium P conveyed through the fixing device 12, and the heat storage state of the fixing device 12.

A description is provided of the correction control between devices.

According to the fourth embodiment, the controller 22 adjusts the rotation time for which the cam 18*d* rotates from the reference position, thus adjusting the position of the pressure roller 17 under the control method for adjusting the length of the fixing nip N in the recording medium conveyance direction H.

Figure 12:
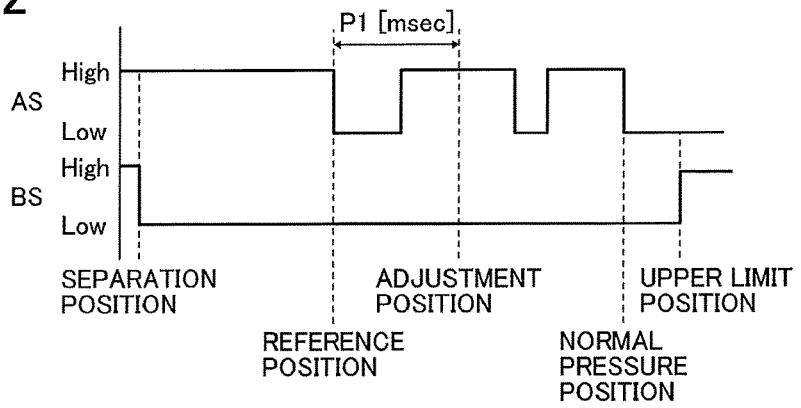
FIG. 12 is a timing chart for explaining a control for adjusting a position of the pressure roller of the fixing device depicted in FIG. 5 according to a fourth embodiment.

FIG. 12 is a timing chart for explaining a control for adjusting the position of the pressure roller 17. For example, two sensors, that is, sensors AS and BS, detect two feelers having different shapes, respectively, and being mounted on an identical shaft that mounts the cam 18*d* of the pressure roller mover 18. The controller 22 determines the position of the pressure roller 17 based on detection results provided by the sensors AS and BS. FIG. 12 illustrates a separation position, the reference position (e.g., the default position), an adjustment position, a normal pressure position, and an upper limit position of the pressure roller 17.

If the recording medium P is plain paper or the like, the recording medium P is conveyed while the pressure roller 17 is at a fixed pressing position (e.g., the normal pressure position). If the recording medium P is a sheet that defines a decreased length of the fixing nip N in the recording medium conveyance direction H such as an envelope, the pressure roller 17 is at the adjustment position where the controller 22 adjusts the pressing position of the pressure roller 17.

Since the adjustment position is defined by the rotation time (e.g., a rotation time P1 [msec]) of the cam 18*d*, that is, a driving time of the pressure roller mover 18, from the reference position, the controller 22 changes the adjustment position continuously. However, even if the rotation time P1 is constant, the position of the pressure roller 17 may vary between the fixing devices 12 due to variation in the outer diameter and the hardness of the fixing roller 15 and variation in the dimension of the cam 18*d*. Accordingly, the fixing devices 12 in a particular lot may not attain the desired length of the fixing nip N in the recording medium conveyance direction H. To address this circumstance, the controller 22 performs the correction control between devices described below.

Figure 13:
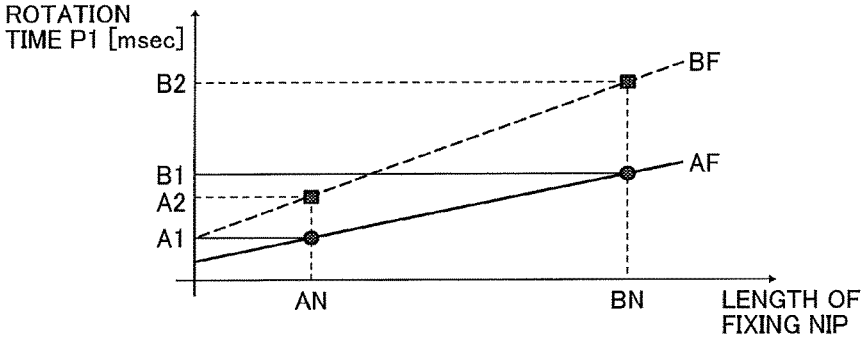
FIG. 13 is a graph illustrating a relation between the length of the fixing nip and a rotation time of the cam of the fixing device according to the fourth embodiment.

FIG. 13 is a graph illustrating a relation between the length of the fixing nip N in the recording medium conveyance direction H and the rotation time P1 of the cam 18*d*. Under the correction control between devices, the controller 22 obtains at least two data about the length of the fixing nip N in the recording medium conveyance direction H relative to the rotation time P1 of the cam 18*d* for each of the fixing devices 12. The controller 22 obtains the at least two data while the fixing roller 15 is thermally saturated so as to avoid an influence by thermal expansion of the fixing roller 15.

The controller 22 derives a linear function from the at least two data that are obtained. Preferably, the controller 22 derives the linear function or greater by increasing the volume of data. The controller 22 calculates the rotation time P1 of the cam 18*d* based on a relational expression that is obtained so as to attain the desired length of the fixing nip N in the recording medium conveyance direction H.

For example, as illustrated in FIG. 13, a fixing device AF defines a rotation time A1 of the cam 18*d* to obtain a length AN of the fixing nip N in the recording medium conveyance direction H. The fixing device AF defines a rotation time B1 of the cam 18*d* to obtain a length BN of the fixing nip N in the recording medium conveyance direction H. A fixing device BF defines a rotation time A2 to obtain the length AN of the fixing nip N in the recording medium conveyance direction H. The fixing device BF defines a rotation time B2 to obtain the length BN of the fixing nip N in the recording medium conveyance direction H. Accordingly, the controller 22 calculates the rotation time P1 of the cam 18*d* of the fixing device 12 to attain the desired length of the fixing nip N in the recording medium conveyance direction H.

With the fixing device 12 according to the fourth embodiment described above, in view of machining errors of the components and the like of the fixing device 12 between units or lots, the controller 22 performs a control for eliminating the machining errors. For example, the controller 22 determines the rotation time P1 of the cam 18*d*, which is used to determine the position of the pressure roller 17, based on the relation between the length of the fixing nip N in the recording medium conveyance direction H and the rotation time P1 of the cam 18*d*, which is calculated for each of the fixing devices 12. Accordingly, the controller 22 eliminates machining errors of the components and the like of the fixing devices 12 between lots. Thus, regardless of the lots of the fixing devices 12, the controller 22 retains the length of the fixing nip N in the recording medium conveyance direction H, which stably assures quality of fixing the toner image T on the recording medium P and quality of conveying the recording medium P.

The combination of the correction control between devices and the heat storage and rotation control according to the third embodiment retains the length of the fixing nip N in the recording medium conveyance direction H, which stably assures quality of fixing the toner image T on the recording medium P and quality of conveying the recording medium P, regardless of the lot of the fixing device 12, the type (e.g., the brand) of the recording medium P conveyed through the fixing device 12, and the heat storage state of the fixing device 12.

A description is provided of a configuration of the fixing device 12 according to a fifth embodiment.

The fixing device 12 according to the fourth embodiment performs the correction control between devices, which eliminates machining errors such as variation in the outer diameter and the hardness of the fixing roller 15 and variation in the dimension of the cam 18*d* of the pressure roller mover 18. Under the correction control between devices, the controller 22 stores in advance a value indicating the relation between the length of the fixing nip N in the recording medium conveyance direction H and the rotation time P1 of the cam 18*d* as a parameter (e.g., a correlation function under linear function) for each of the fixing devices 12. The controller 22 calculates the rotation time P1 of the cam 18*d* to obtain an appropriate length of the fixing nip N in the recording medium conveyance direction H for each of the fixing devices 12. Accordingly, the controller 22 determines an appropriate position of the pressure roller 17 for each of the fixing devices 12.

The parameter such as the correlation function is described on a label attached to a body of the fixing device 12, a box accommodating the fixing device 12, a document attached to the fixing device 12, or the like. When an operator (e.g., a service engineer or a user) replaces the fixing device 12, the operator inputs the parameter with the control panel of the image forming apparatus 100 so that the memory 30 of the controller 22 located in the image forming apparatus 100 or the fixing device 12 stores the parameter.

However, if the image forming apparatus 100 is configured to cause the operator to input the parameter, the image forming apparatus 100 may impose a complex input process upon the operator or the operator may input the parameter erroneously. If the user uses a plurality of fixing devices 12 properly for a single, image forming apparatus 100, the image forming apparatus 100 may impose the complex input process upon the user whenever the user replaces the fixing device 12, degrading usability of the image forming apparatus 100.

To address those circumstances, the fixing device 12 according to the fifth embodiment includes an integrated circuit (IC) tag that stores the parameter. When the user replaces the fixing device 12, the image forming apparatus 100 retrieves the parameter stored in the IC tag and writes the parameter into a memory (e.g., the memory 30) of the image forming apparatus 100. In other words, the parameter stored in the IC tag is sent to the memory 30 of the image forming apparatus 100. Accordingly, the controller 22 performs the correction control between devices based on the parameter written into the memory 30 of the image forming apparatus 100.

Figure 14:
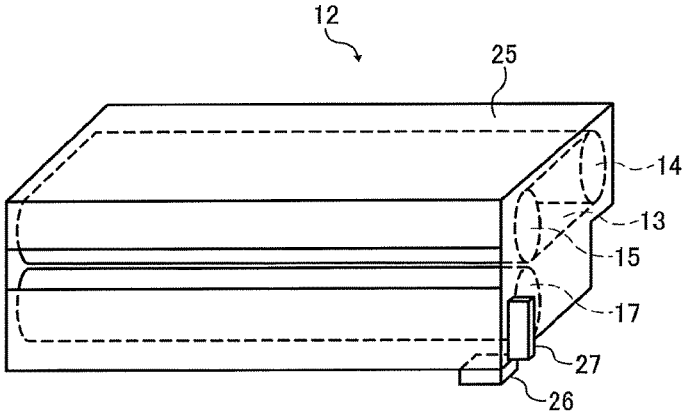
FIG. 14 is an external perspective view of the fixing device depicted in FIG. 5 according to a fifth embodiment.

FIG. 14 is an external perspective view of the fixing device 12 according to the fifth embodiment. As illustrated in FIG. 14, the fixing device 12 includes a body 25 attached with an IC tag 26. The IC tag 26 is one of compact electronic devices that work upon receiving an electric wave. For example, a radiofrequency identification (RFID) tag or the like is used as the IC tag 26. The IC tag 26 is constructed of a compact semiconductor chip and an antenna. The semiconductor chip has a square size in a range of from about 0.4 mm to about 1.0 mm. The antenna (e.g., a loop antenna) is a communicator that performs wireless communication with an external device. The semiconductor chip is installed with a memory.

The IC tag 26 employs an electromagnetic induction system in which an IC tag reader emits an electric wave that generates a micro amount of power. The IC tag 26 performs information processing by using a built-in tag identification (ID) or the like with the power and sends the electric wave.

The IC tag reader includes an antenna, a tuner, and a reader IC, for example. The IC tag reader is disposed inside the image forming apparatus 100 in an area where the IC tag reader is capable of communicating with the IC tag 26. The IC tag reader may be a part of a controller (e.g., the controller 22) of the image forming apparatus 100 or may be provided separately from the controller of the image forming apparatus 100 such that the IC tag reader is coupled to the controller to send and receive information.

The IC tag reader reads an electric wave signal sent from the IC tag 26 to obtain information from the IC tag 26. The IC tag reader is disposed in proximity to the IC tag 26 in view of electric wave output. The IC tag reader has a writing function to rewrite the information from the IC tag 26 as needed, thus serving as an IC reader-writer.

The IC tag 26 is attached to the body 25 of the fixing device 12 at a position below the heater 24 depicted in FIG. 5 and in proximity to the pressure roller 17 so that the IC tag 26 is not damaged thermally. For example, as illustrated in FIG. 14, the IC tag 26 is disposed below a connector 27 (e.g., a drawer connector) that is attached to the body 25 of the fixing device 12 and connects the fixing device 12 to the image forming apparatus 100. The position where the IC tag 26 is attached to the body 25 of the fixing device 12 and the position where the IC tag reader is located inside the image forming apparatus 100 are not limited to the position illustrated in FIG. 14 as long as the IC tag reader receives the electric wave sent from the IC tag 26.

With the fixing device 12 according to the fifth embodiment described above, the IC tag 26 of the fixing device 12 stores information indicating the relation between the length of the fixing nip N in the recording medium conveyance direction H and the rotation time P1 of the cam 18*d*, which varies between the fixing devices 12. When the user replaces the fixing device 12, the image forming apparatus 100 retrieves the parameter stored in the IC tag 26 and writes the parameter into the memory 30 of the image forming apparatus 100. The controller 22 performs the correction control between devices based on the parameter written into the memory 30 of the image forming apparatus 100.

Accordingly, when the user replaces the fixing device 12, the user or the service engineer need not input the parameter into the image forming apparatus 100 directly, enhancing usability. For example, if the user uses the plurality of fixing devices 12 properly, the user need not input the parameter into the image forming apparatus 100 directly whenever the user replaces the fixing device 12, enhancing usability.

With the fixing device 12 according to the fifth embodiment described above, the IC tag 26 of the fixing device 12 stores information indicating the relation between the length of the fixing nip N in the recording medium conveyance direction H and the rotation time P1 of the cam 18*d*. Alternatively or accordingly, the IC tag 26 of the fixing device 12 may store other necessary information properly and the IC tag reader of the image forming apparatus 100 may read the information into the memory 30 when the user or the service engineer replaces the fixing device 12. The IC tag reader may work as the IC tag reader-writer as needed to add and update information to the IC tag 26 of the fixing device 12.

In the embodiments described below, the description is provided by referring to the color laser printer employing the tandem system as one example of the image forming apparatus 100. However, the embodiments described above are applicable to other image forming apparatuses that include a fixing device. The embodiments are described by referring to the fixing devices 11 and 12 employing the belt fixing system. However, the embodiments described above are applicable to fixing devices employing other fixing systems. The configuration and the control described in each of the embodiments described above are applicable to other embodiments.

A description is provided of advantages of the fixing devices 11 and 12.

As illustrated in FIGS. 2 and 5, a fixing device (e.g., the fixing devices 11 and 12) includes a first roller or a heating roller (e.g., the heating roller 14), a second roller or a fixing roller (e.g., the fixing roller 15), a heater (e.g., the heater 24), a fixing belt (e.g., the fixing belt 13), a pressure rotator (e.g., the pressure roller 17), a clearance detector (e.g., the clearance sensor 21), a mover (e.g., the pressure roller mover 18), and a controller (e.g., the controller 22).

The fixing roller includes an elastic layer (e.g., the elastic layer 15*b*) as an outer circumferential layer. The heater heats at least one of the heating roller and the fixing roller. The fixing belt is stretched taut across at least the fixing roller and the heating roller. The pressure rotator is pressed against the fixing roller via the fixing belt to form a fixing nip (e.g., the fixing nip N) between the pressure rotator and the fixing belt. The clearance detector detects a clearance between the fixing roller and the heating roller. The mover moves the pressure rotator with respect to the fixing roller in a pressing direction in which the pressure rotator presses against the fixing roller via the fixing belt and a separation direction in which the pressure rotator separates from the fixing roller. The controller controls an amount of movement of the pressure rotator moved by the mover toward the fixing roller based on the clearance between the fixing roller and the heating roller, which is detected by the clearance detector.

Accordingly, the controller adjusts a length of the fixing nip in a recording medium conveyance direction (e.g., the recording medium conveyance direction H) appropriately without degrading productivity, retaining stable fixing performance.

According to the embodiments described above, the pressure roller 17 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. An image forming apparatus comprising:

a first roller;

a second roller including an elastic layer as an outer circumferential layer;

a fixing belt stretched taut across at least the first roller and the second roller;

a pressure rotator to press against the second roller via the fixing belt to form a fixing nip between the pressure rotator and the fixing belt, the fixing nip through which a recording medium bearing a toner image is conveyed;

a clearance detector to detect a clearance between the first roller and the second roller;

a mover to move the pressure rotator with respect to the second roller in a pressing direction in which the pressure rotator presses against the second roller via the fixing belt and a separation direction in which the pressure rotator separates from the second roller; and a controller to control an amount of movement of the pressure rotator moved by the mover toward the second roller based on the clearance detected by the clearance detector.

2. The image forming apparatus according to claim 1, wherein the mover moves the pressure rotator toward the second roller directly from a pre-movement position to a post-movement position.

3. The image forming apparatus according to claim 1, wherein the clearance detector detects the clearance before the recording medium is conveyed through the fixing nip.

4. The image forming apparatus according to claim 1, wherein the clearance detector detects the clearance during an interval between successive recording media conveyed through the fixing nip.

5. The image forming apparatus according to claim 1, wherein the second roller rotates in accordance with rotation of the pressure rotator.

6. An image forming apparatus comprising:

a fixing roller including:

a core bar; and an elastic layer coating the core bar;

a pressure rotator to press against the fixing roller to form a fixing nip between the pressure rotator and the fixing roller, the fixing nip through which a recording medium bearing a toner image is conveyed;

a core bar temperature detector to detect a temperature of the core bar of the fixing roller;

a mover to move the pressure rotator with respect to the fixing roller in a pressing direction in which the pressure rotator presses against the fixing roller and a separation direction in which the pressure rotator separates from the fixing roller; and a controller to control the mover to move the pressure rotator gradually from a default position in the separation direction whenever the temperature of the core bar detected by the core bar temperature detector exceeds each of a plurality of thresholds for the temperature of the core bar.

7. The image forming apparatus according to claim 6, wherein the controller defines the plurality of thresholds, the default position, and an amount of movement of the pressure rotator in the separation direction according to a type of the recording medium.

8. The image forming apparatus according to claim 6, wherein the controller starts a control excluded time when the controller does not move the pressure rotator before one of a first condition and a second condition is satisfied, wherein the first condition is that a predetermined time has elapsed after the image forming apparatus receives a print job, and wherein the second condition is that a difference between a current temperature of the core bar and a previous temperature of the core bar when the image forming apparatus receives the print job is a predetermined temperature or higher.

9. An image forming apparatus comprising:

a fixing device including:

a fixing roller including:

a core bar; and an elastic layer coating the core bar;

a pressure rotator to press against the fixing roller to form a fixing nip between the pressure rotator and the fixing roller, the fixing nip through which a recording medium bearing a toner image is conveyed;

a core bar temperature detector to detect a temperature of the core bar of the fixing roller; and a mover to move the pressure rotator with respect to the fixing roller in a pressing direction in which the pressure rotator presses against the fixing roller and a separation direction in which the pressure rotator separates from the fixing roller; and a controller to control the mover to move the pressure rotator according to the temperature of the core bar detected by the core bar temperature detector while the recording medium is conveyed through the fixing nip, the controller to determine a heat storage state of the fixing roller after the image forming apparatus receives a current print job and before the recording medium is conveyed through the fixing nip, the controller to perform a heat storage and movement control to heat the fixing roller and move the pressure rotator based on the determined heat storage state.

10. The image forming apparatus according to claim 9, wherein the mover moves the pressure rotator during an interval between successive recording media conveyed through the fixing nip.

11. The image forming apparatus according to claim 10, wherein the controller increases the interval between the successive recording media temporarily if the controller determines that movement of the pressure rotator does not finish within the interval.

12. The image forming apparatus according to claim 9, wherein the controller determines the heat storage state of the fixing roller based on at least one of information about the recording medium of the current print job, information about the recording medium of a previous print job, an elapsed time elapsed after the previous print job, and an elapsed time elapsed after the image forming apparatus is powered on.

13. The image forming apparatus according to claim 9, wherein the controller determines whether or not to perform the heat storage and movement control.

14. The image forming apparatus according to claim 9, wherein the controller controls the mover based on a relation between a driving time of the mover and a length of the fixing nip in a recording medium conveyance direction, the relation being derived in advance of the fixing device.

15. The image forming apparatus according to claim 14, further comprising:

an integrated circuit tag to store a parameter indicating the relation; and a memory to receive the parameter sent from the integrated circuit tag.

16. The image forming apparatus according to claim 15, wherein the fixing device further includes a body attached with the integrated circuit tag.

17. The image forming apparatus according to claim 15, further comprising a connector, disposed above the integrated circuit tag, to connect the fixing device to the image forming apparatus.

18. The image forming apparatus according to claim 9, wherein the mover includes a cam.

* * * * *